US010336960B2

(12) United States Patent
Nguyen et al.

(10) Patent No.: US 10,336,960 B2
(45) Date of Patent: Jul. 2, 2019

(54) LUBRICATING COMPOSITIONS COMPRISING THERMOASSOCIATIVE AND EXCHANGEABLE COPOLYMERS

(71) Applicants: TOTAL MARKETING SERVICES, Puteaux (FR); ECOLE SUPERIEURE DE PHYSIQUE ET DE CHIMIE INDUSTRIELLES DE LA VILLE DE PARIS (ESPCI), Paris (FR); CENTRE NATIONAL DE LA RECHERCHE SCIENTIFIQUE (CNRS), Paris (FR)

(72) Inventors: Thi Hang Nga Nguyen, Le Kremlin Bicêtre (FR); Renaud Nicolay, Verrières le Buisson (FR); Raphaele Iovine, Mornant (FR); Ilias Iliopoulos, Paris (FR)

(73) Assignees: Total Marketing Services, Puteaux (FR); Ecole Superieure de Physique et de Chimie Industrielles de la Ville de Paris (ESPCI), Paris (FR); Centre National de la Recherche Scientifique (CNRS), Paris (FR)

( * ) Notice: Subject to any disclaimer, the term of this patent is extended or adjusted under 35 U.S.C. 154(b) by 148 days.

(21) Appl. No.: 15/114,157

(22) PCT Filed: Jan. 26, 2015

(86) PCT No.: PCT/EP2015/051518
§ 371 (c)(1),
(2) Date: Jul. 26, 2016

(87) PCT Pub. No.: WO2015/110643
PCT Pub. Date: Jul. 30, 2015

(65) Prior Publication Data

US 2017/0009176 A1 Jan. 12, 2017

(30) Foreign Application Priority Data

Jan. 27, 2014 (FR) ..... 14 50657

(51) Int. Cl.
*C10M 145/14* (2006.01)

(52) U.S. Cl.
CPC .. *C10M 145/14* (2013.01); *C10M 2203/1006* (2013.01); *C10M 2203/1025* (2013.01);
(Continued)

(58) Field of Classification Search
CPC ..... C10N 2230/02; C10N 2230/06; C10N 2230/08; C10N 2230/18; C10N 2230/10; C10M 2203/1006; C10M 2209/084
See application file for complete search history.

(56) References Cited

U.S. PATENT DOCUMENTS 4,401,797 A 8/1983 Gallop
5,370,807 A 12/1994 Gambini et al.

FOREIGN PATENT DOCUMENTS

WO WO-2013147795 A1 10/2013

*Primary Examiner* — Vishal V Vasisth
(74) *Attorney, Agent, or Firm* — Harness, Dickey & Pierce, PLC

(57) ABSTRACT

A composition results from the mixture of at least one lubricating oil, at least one statistical copolymer A1 , and at least one compound A2 including at least two boronic ester functions; the statistical copolymer A1 resulting from the copolymerisation of at least a first monomer M1 having diol functions and at least a second monomer M2 having a different chemical structure from that of the M1 monomer. The composition lubricates a mechanical part. The field is that of lubricants.

20 Claims, 8 Drawing Sheets

(52) U.S. Cl.
CPC . *C10M 2209/084* (2013.01); *C10N 2220/021* (2013.01); *C10N 2230/02* (2013.01); *C10N 2230/06* (2013.01); *C10N 2230/08* (2013.01); *C10N 2230/10* (2013.01); *C10N 2230/18* (2013.01)

LUBRICATING COMPOSITIONS COMPRISING THERMOASSOCIATIVE AND EXCHANGEABLE COPOLYMERS

CROSS-REFERENCE TO RELATED APPLICATIONS

This application is a National Phase Entry of International Patent Application No. PCT/EP2015/051518, filed on Jan. 26, 2015, which claims priority to French Patent Application Serial No. 1450657, filed on Jan. 27, 2014, both of which are incorporated by reference herein.

TECHNICAL FIELD

The present invention relates to a composition resulting from the mixture of at least one lubricating oil, at least one statistical copolymer A1, and at least one compound A2 comprising at least two boronic ester functions; the statistical copolymer A1 results from the copolymerization of at least one first monomer M1 bearing diol functions and at least one second monomer M2 of different chemical structure to that of the monomer M1. The invention also relates to the use of this composition for lubricating a mechanical part. The field of the present invention is that of lubricants.

BACKGROUND

Lubricating compositions are compositions applied between the surfaces, in particular metallic surfaces, of moving parts. They make it possible to reduce the friction and wear between two parts that are in contact and moving with respect to each other. They also serve to dissipate part of the heat energy generated by this friction. The lubricating compositions form a protective film between the surfaces of the parts on which they are applied.

The compositions used for the lubrication of mechanical parts are generally constituted by a base oil and additives. The viscosity of the base oil, in particular of petroleum or synthetic origin, varies when the temperature is changed.

Indeed, when the temperature of a base oil increases, its viscosity reduces, and when the temperature of the base oil reduces, its viscosity increases. Now, the thickness of the protective film is proportional to the viscosity and therefore also depends on the temperature. A composition has good lubricating properties if the thickness of the protective film remains substantially constant whatever the conditions and duration of use of the lubricant.

In an internal combustion engine, a lubricating composition can be subjected to changes in external or internal temperature. The changes in external temperature are due to the variations in temperature of the ambient air, such as the variations in temperature between summer and winter for example. The internal changes in temperature result from the running of the engine. The temperature of an engine is lower during its start-up phase, in particular in cold weather, than during prolonged use. As a result, the thickness of the protective film can vary in these different situations. A need therefore exists to have available a lubricating composition having good lubrication properties and the viscosity of which is not significantly affected by variations in temperature.

It is known to add additives that improve the viscosity of a lubricating composition. These additives have the function of modifying the rheological behaviour of the lubricating composition. They make it possible to promote a substantially constant viscosity over a temperature range at which the lubricating composition is used. For example, these additives limit the reduction in the viscosity of the lubricating composition when the temperature increases or limit the increase in the viscosity of the lubricating composition when the temperature reduces.

The additives improving the viscosity (or additives improving the viscosity index) currently used are polymers such as the polyalpha-olefins, methyl polymethacrylates, copolymers resulting from the polymerization of an ethylene monomer and an alpha-olefin. These are high molecular weight polymers. In general, the contribution of these polymers to controlling the viscosity is greater, the higher their molecular weight. However, the high molecular weight polymers have the drawback of having a low permanent shear strength compared with polymers of the same nature but a smaller size.

Now, a lubricating composition is subjected to significant shear stresses in particular in internal combustion engines, where the surfaces subject to friction have a very small clearance and the pressures exerted on the parts are high. These shearing constraints on the high molecular weight polymers lead to macromolecular chain cleavages. The polymer thus degraded no longer has thickening properties, and the viscosity drops irreversibly. This loss of permanent shear strength therefore leads to a degradation of the lubrication properties of the lubricating composition.

The polymers of the prior art, in particular PMMA (methyl polymethacrylates) have a shear thickening behaviour. At a high shear rate, the PMMA chain breaks. This results in the formation of two molecules having approximately half of the molar weight of the initial PMMA. The total hydrodynamic volume of these two small molecules is less than that of the initial PPMA, which leads to a smaller contribution to the viscosity and this results in a reduction in the viscosity.

The ethylene-alphaolefin copolymers having a high ethylene content are additives improving the viscosity and are stable under shear. However, these polymers have the drawback of aggregating in the compositions containing them and lead to lubricating compositions that are extremely viscous, such as gels. This aggregation generally takes place under ambient conditions or during cooling.

Therefore the Applicant has set himself the objective of the formulation of novel lubricating compositions the viscosity of which is better controlled compared with respect to the lubricating compositions of the prior art. In particular, his objective is to provide novel rheological additives, the behaviour of which when they are introduced into a base oil, is opposite as regards temperature change compared with the behaviour of the base oil and the rheological additives of polymer type of the prior art.

This objective is achieved thanks to novel rheological additives capable of associating, in order to optionally form a gel, and exchanging in thermoreversible manner. Unlike the base oil which liquefies when the temperature increases, the additives of the present invention have the advantage of thickening the medium in which they are dispersed when the temperature increases. This characteristic results from the associated use of two particular compounds, a copolymer bearing diol functions and a compound comprising boronic ester functions.

Polymers, of which at least one monomer comprises boronic ester functions are known from document WO2013147795. These polymers are used for the production of electronic devices, in particular for devices in which it is desired to obtain a flexible user interface. These polymers are also used as synthesis intermediates. They allow the functionalization of the polymers by coupling with luminescent groups, electron-transporter groups, etc. The coupling of these groups is carried out by standard organic chemistry reactions, involving the boron atom, such as for example Suzuki coupling. However, no other use of these polymers in the field of lubricating compositions, nor an association with other compounds is envisaged.

A copolymer resulting from the copolymerization of a methyl methacrylate (MMA) monomer and a glyceryl methacrylate monomer optionally protected by a boronic ester (namely butyl boronic acid adduct of glyceryl methacrylate (BBA-GMA)) is known from document U.S. Pat. No. 4,401,797. This copolymer forms a hydrogel in the presence of water and is used for the production of contact lenses. However, no other use of this copolymer in the field of lubricating compositions, nor a association via exchangeable chemical bonds with other compounds is envisaged.

Document EP0570073 discloses an additive which improves the viscosity index of a lubricating composition in which it is added. This additive is a copolymer resulting from the polymerization of 1-(methacryloylethoxy)-4,4,6-trimethyl-dioxaborinane and a methacrylate of a linear ($C_{12}$-$C_{18}$) alkyl. This additive belongs to the family of the borate compounds which can be represented by the general formula $B(OR)_3$ with R an alkyl or aryl group. This additive does not belong to the family of the boronate compounds which can be represented by the general formula R—$B(OR)_2$ with R an alkyl or aryl group. This additive cannot be associated with other compounds via exchangeable chemical bonds.

Unexpectedly, the Applicant observed that at low temperature, the polydiol copolymer of the invention is not or only slightly cross-linked by the compounds comprising boronic ester functions. When the temperature increases, the diol functions of the copolymer react with the boronic ester functions of the compound containing them by a transesterification reaction. The polydiol statistical copolymers and the compounds comprising boronic ester functions then link together and can exchange. Depending on the functionality of the polydiols and of the compounds comprising boronic ester functions, as well as depending on the composition of the mixtures, a gel may form in the base oil. When the temperature reduces again, the boronic ester bonds between the polydiol statistical copolymers and the compounds containing them break; the composition loses its gelled character, if applicable.

The Applicant has set himself the objective of the formulation of novel rheology additives which are more stable under shearing compared to the compounds of the prior art. This objective is achieved thanks to novel rheological additives which can associate and cross-link in a thermoreversible manner. Unlike the polymers of the prior art, it was noted that the molar weight of the copolymers of the invention is not or only slightly modified when a high shear rate is applied. The copolymers of the invention therefore have the advantage of being more stable under shearing stresses.

SUMMARY

Thus, a subject of the invention is a composition resulting from mixing:

at least one lubricating oil, at least one statistical copolymer A1 and at least one compound A2 comprising at least two boronic ester functions;

the statistical copolymer A1 resulting from the copolymerization:

of at least one first monomer M1 of general formula (I)

(I)

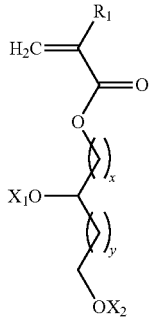

in which:

$R_1$ is selected from the group formed by —H, —$CH_3$, and —$CH_2$—$CH_3$;

x is an integer ranging from 2 to 18;

y is an integer equal to 0 or 1;

$X_1$ and $X_2$, identical or different, are selected from the group formed by hydrogen, tetrahydropyranyl, methyloxymethyl, ter-butyl, benzyl, trimethylsilyl and t-butyl dimethylsilyl;

or $X_1$ and $X_2$ form with the oxygen atoms a bridge of following formula

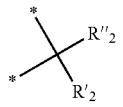

in which:

the stars (*) symbolize the bonds to the oxygen atoms, $R'_2$ and $R''_2$, identical or different, are selected from the group formed by hydrogen and a $C_1$-$C_{11}$ alkyl, preferably methyl;

or $X_1$ and $X_2$ form with the oxygen atoms a boronic ester of following formula

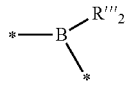

in which:

the stars (*) symbolize the bonds to the oxygen atoms, $R'''_2$ is selected from the group formed by a $C_6$-$C_{18}$ aryl, a $C_7$-$C_{18}$ aralkyl and $C_2$-$C_{18}$ alkyl, preferably a $C_6$-$C_{18}$ aryl;

with at least one second monomer M2 of general formula (II-A):

(II-A)

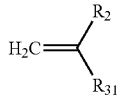

in which:

$R_2$ is selected from the group formed by —H, —$CH_3$ and —$CH_2$—$CH_3$, $R_3$ is selected from the group formed by a $C_6$-$C_{18}$ aryl, a $C_6$-$C_{18}$ aryl substituted by an $R'_3$, —C(O)—O—$R'_3$, —O—$R'_3$, —S—$R'_3$ and —C(O)—N(H)—$R'_3$ group with $R'_3$ a $C_1$-$C_{30}$ alkyl group; and In a variant, the statistical copolymer A1 results from the copolymerization of at least one monomer M1 with at least two monomers M2 having different $R_{31}$ groups.

Preferably, one of the monomers M2 of the statistical copolymer A1 has the general formula (II-A1):

(II-A1)

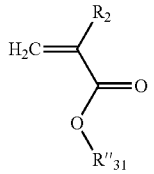

in which:

$R_2$ is selected from the group formed by —H, —$CH_3$ and —$CH_2$—$CH_3$, $R''_{31}$ is a $C_1$-$C_{14}$ alkyl group, and the other monomer M2 of the statistical copolymer A1 has the general formula (II-A2):

(II-A2)

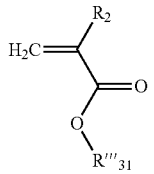

in which:

$R_2$ is selected from the group formed by —H, —$CH_3$ and —$CH_2$—$CH_3$, $R'''_{31}$ is a $C_{15}$-$C_{30}$ alkyl group.

In a variant of the composition, compound A2 is a compound of formula (III):

(III)

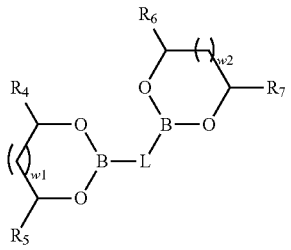

in which:

$w_1$ and $w_2$, identical or different are integers selected between 0 and 1;

$R_4$, $R_5$, $R_6$ and $R_7$, identical or different are selected from the group formed by hydrogen and a hydrocarbon-containing group having from 1 to 24 carbon atoms, preferably between 4 and 18 carbon atoms, preferably between 6 and 14 carbon atoms;

L is a divalent bond group and is selected from the group formed by a $C_6$-$C_{18}$ aryl, a $C_6$-$C_{18}$ aralkyl and a $C_2$-$C_{24}$ hydrocarbon-containing chain.

In another variant of the composition, compound A2 is a statistical copolymer resulting from the copolymerization:

of at least one monomer M3 of formula (IV):

(IV)

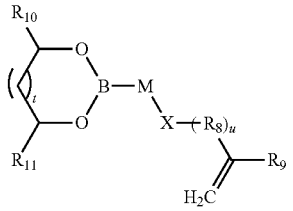

in which:

t is an integer equal to 0 or 1;

u is an integer equal to 0 or 1;

M and $R_8$ are divalent bond groups, identical or different, selected from the group formed by a $C_6$-$C_{18}$ aryl, a $C_7$-$C_{24}$ aralkyl and a $C_2$-$C_{24}$ alkyl, preferably a $C_6$-$C_{18}$ aryl, X is a function selected from the group formed by —O—C(O)—, —C(O)—O—, —C(O)—N(H)—, —N(H)—C(O)—, —S—, —N(H)—, —N($F_4$)— and —O— with $R'_4$ a hydrocarbon-containing chain comprising from 1 to 15 carbon atoms;

$R_9$ is selected from the group formed by —H, —$CH_3$ and —$CH_2$—$CH_3$;

$R_{10}$ and $R_{11}$ identical or different are selected from the group formed by hydrogen and a hydrocarbon-containing group having from 1 to 24 carbon atoms, preferably between 4 and 18 carbon atoms, preferably between 6 and 14 carbon atoms;

with at least one second monomer M4 of general formula (V):

(V)

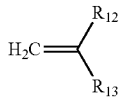

in which:

$R_{12}$ is selected from the group formed by —H, —$CH_3$ and —$CH_2$—$CH_3$, $R_{13}$ is selected from the group formed by a $C_6$-$C_{18}$ aryl, a $C_6$-$C_{18}$ aryl substituted by an $R'_{13}$, —C(O)—O—$R'_{13}$; —O—$R'_{13}$, —S—$R'_{13}$ and —C(O)—N(H)—$R'_{13}$ group, with $R'_{13}$ a $C_1$-$C_{25}$ alkyl group.

Preferably, the compositions described above comprise one or more of the characteristics below, taken separately or in combination:

the chain formed by the sequence of the $R_{10}$, M, X and $(R_8)_u$ groups with u an integer equal to 0 or 1 of the monomer of general formula (IV) has a total number of carbon atoms comprised between 8 and 38, preferably between 10 and 26 carbon atoms;

the side chains of the copolymer A2 have an average length greater than or equal to 8 carbon atoms, preferably ranging from 11 to 16 carbon atoms;

the statistical copolymer A2 has a molar percentage of monomer of formula (IV) in said copolymer ranging from 0.25 to 20%, preferably from 1 to 10%;

the statistical copolymer A2 has a number-average degree of polymerization ranging from 50 to 1500, preferably from 80 to 800;

the side chains of the statistical copolymer A1 have a average length ranging from 8 to 20 carbon atoms, preferably from 9 to 15 carbon atoms;

the statistical copolymer A1 has a molar percentage of monomer M1 of formula (I) in said copolymer ranging from 1 to 30%, preferably ranging from 5 to 25, more preferably ranging from 9 to 21%;

the statistical copolymer A1 has an average degree of polymerization ranging from 100 to 2,000, preferably from 150 to 1,000;

the lubricating oil is selected from the oils of Group I, Group II, Group III, Group IV, Group V of the API classification and one mixture thereof;

the composition further comprises a functional additive selected from the group formed by the detergents, anti-wear additives, extreme-pressure additives, additional antioxidants, polymers improving the viscosity index, pour point improvers, anti-foaming agents, corrosion inhibitors, thickeners, dispersants, friction modifiers and mixtures thereof;

the mass ratio in the composition between the statistical copolymer A1 and the compound A2 (ratio A1 /A2) ranges from 0.001 to 100, preferably from 0.05 to 20, yet more preferably from 0.1 to 10, yet more preferably from 0.2 to 5;

the sum of the masses of the statistical copolymer A1 and of the compound A2 in the composition ranges from 0.5 to 20% with respect to the total mass of the lubricating composition and the mass of lubricating oil ranges from 80% to 99.5% with respect to the total mass of the lubricating composition.

A subject of the invention is also the use of a composition such as described above for lubricating a mechanical part.

A subject of the invention is also a stock composition resulting from the mixture of:

at least one statistical copolymer A1;

at least one compound A2 comprising at least two boronic ester functions; and at least one functional additive selected from the group formed by the detergents, anti-wear additives, extreme-pressure additives, antioxidants, polymers improving the viscosity index, pour point improvers, anti-foaming agents, corrosion inhibitors, thickeners, dispersants, friction modifiers and mixtures thereof;

the statistical copolymer A1 resulting from the copolymerization of at least one first monomer M1 of general formula (I)

(I)

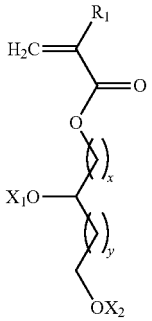

in which:

$R_1$ is selected from the group formed by —H, —$CH_3$ and —$CH_2$—$CH_3$, x is an integer ranging from 2 to 18;

y is an integer equal to 0 or 1;

$X_1$ and $X_2$, identical or different, are selected from the group formed by hydrogen, tetrahydropyranyl, methyloxymethyl, ter-butyl, benzyl, trimethylsilyl and t-butyl dimethylsilyl;

or $X_1$ and $X_2$ form with the oxygen atoms a bridge of following formula

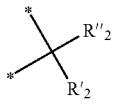

in which:

the stars (*) symbolize the bonds to the oxygen atoms, $R'_2$ and $R''_2$, identical or different, are selected from the group formed by hydrogen and a $C_1$-$C_{11}$ alkyl, preferably methyl;

or $X_1$ and $X_2$ form with the oxygen atoms a boronic ester of the following formula

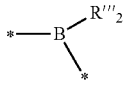

in which:

the stars (*) symbolize the bonds to the oxygen atoms, $R'''_2$ is selected from the group formed by a $C_6$-$C_{18}$ aryl, a $C_7$-$C_{18}$ aralkyl and $C_2$-$C_{18}$ alkyl, preferably a $C_6$-$C_{18}$ aryl;

with at least one second monomer M2 of general formula (II-A):

(II-A)

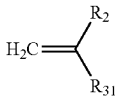

in which:

$R_2$ is selected from the group formed by —H, —$CH_3$ and —$CH_2$—$CH_3$, $R_{31}$ is selected from the group formed by a $C_6$-$C_{18}$ aryl, a $C_6$-$C_{18}$ aryl substituted by an $R'_3$, —C(O)—O—$R'_3$, —O—$R'_3$, —S—$R'_3$ and —C(O)—N(H)—$R'_3$ group with $R'_3$ a $C_1$-$C_{30}$ alkyl group.

DETAILED DESCRIPTION

Figure 1:
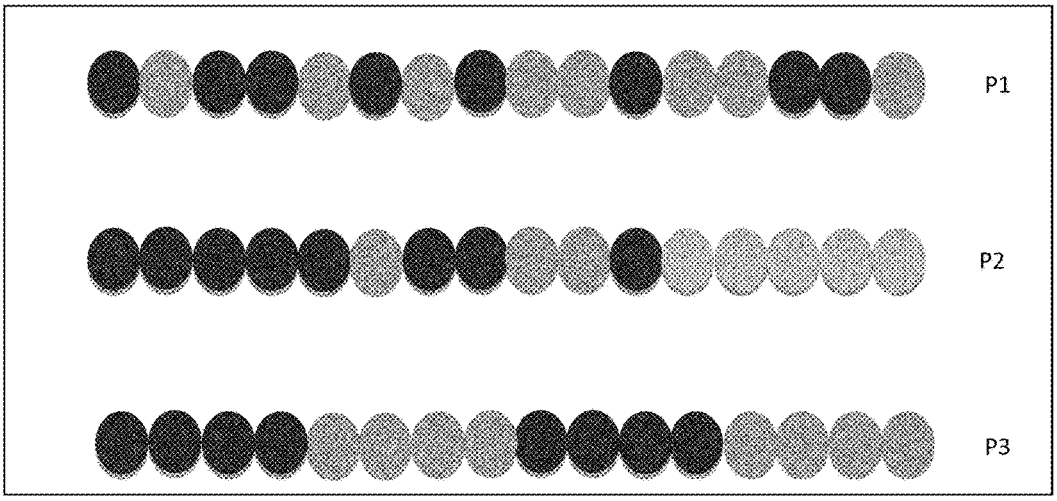
FIG. 1 shows diagrammatically a statistical copolymer (P1), a gradient copolymer (P2) and a block copolymer (P3); each circle shows a monomer unit. The difference in chemical structure between the monomers is symbolized by a different colour (light grey/black).

A first subject of the invention is a composition resulting from the mixing of:

at least one lubricating oil, at least one statistical copolymer A1, and at least one compound A2 comprising at least two boronic ester functions;

the statistical copolymer A1 resulting from the copolymerization of at least one first monomer M1 bearing diol functions and at least one second monomer M2 of different chemical structure to that of the monomer M1.

Lubricating Base Oil

By "oil" is meant a fatty substance which is liquid at ambient temperature (25° C.) and atmospheric pressure (760 mm of Hg, i.e. 105 Pa). By "lubricating oil" is meant a oil which attenuates the friction between two moving parts with a view facilitating the operation of these parts. Lubricating oils can be of natural, mineral or synthetic origin. The lubricating oils of natural origin can be oils of vegetable or animal origin, preferably oils of vegetable origin such as rapeseed oil, sunflower oil, palm oil, coconut oil etc.

The lubricating oils of mineral origin are of petroleum origin and are extracted from petroleum cuts originating from the atmospheric and vacuum distillation of crude oil. The distillation can be followed by refining operations such as solvent extraction, deasphalting, solvent dewaxing, hydrotreatment, hydrocracking, hydroisomerization, hydrofinishing etc. By way of illustration, the following can be mentioned: the paraffinic mineral base oils such as Bright Stock Solvent (BSS oil, napthenic mineral base oils, aromatic mineral oils, hydrorefined mineral bases the viscosity index of which is approximately 100, hydrocracked mineral bases the viscosity index of which is comprised between 120 and 130, hydroisomerized mineral bases the viscosity index of which is comprised between 140 and 150.

The lubricating oils of synthetic origin (or synthetic base) originate as their name indicates from chemical synthesis such as addition of a product with itself or polymerization, or the addition of a product to another such as esterification, alkylation, fluorination, etc., of compounds originating from petrochemistry, carbochemistry, and mineral chemistry such as: olefins, aromatics, alcohols, acids, halogenated, phosphorus-containing, silicon-containing compounds, etc. By way of illustration, the following can be mentioned:

the synthetic oils based on synthesis hydrocarbons such as polyalphaolefins (PAO), internal polyolefins (PIO), polybutenes and polyisobutenes (PIB), dialkylbenenes, alkylated polyphenyls;

the synthetic oils based on esters such as diacid esters, neopolyol esters;

the synthetic oils based on polyglycols such as monoalkyleneglycols, polyalkyleneglycols and polyalkyleneglycol monoethers;

the synthetic oils based on ester-phosphates;

the synthetic oils based on silicon-containing derivatives such as the silicone oils or polysiloxanes.

The lubricating oils which can be used in the composition of the invention can be selected from any of the oils of Groups I to V specified in the Base Oil Interchangeability Guidelines of the American Petroleum Institute (API) (or their equivalents according to the ATIEL classification (Association Technique de l'Industrie Européenne des Lubrifiants) such as summarized below:

| | Saturates content* | Sulphur content** | Viscosity index (VI)** |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |

-continued

| | Saturates content* | Sulphur content** | Viscosity index (VI)** |
|---|---|---|---|
| Group III Hydrocracked or hydro-isomerized oils | ≥90% | ≤0.03% | ≥120 |
| Group IV | (PAO) Polyalphaolefins | | |
| Group V | Esters and other bases not included in bases of Groups I to IV | | |

*measured according to the standard ASTM D2007

**measured according to the standards ASTM D2622, ASTM D4294, ASTM D4927 and ASTM D3120

**measured according to the standard ASTM D2270

The compositions of the invention can comprise one or more lubricating oils. The lubricating oil or the mixture of lubricating oils represents at least 50% by weight with respect to the total weight of the composition. Preferably, the lubricating oil or the mixture of lubricating oils represents at least 70% by weight with respect to the total weight of the composition.

In an embodiment of the invention, the lubricating oil is selected from the group formed by the oils of Group I, Group II, Group III, Group IV, Group V of the API classification and one of the mixtures thereof. Preferably, the lubricating oil is selected from the group formed by the oils of Group III, Group IV, Group V of the API classification and mixtures thereof. Preferably, the lubricating oil is an oil of group III of the API classification. The lubricating oil has a kinematic viscosity at 100° C. measured according to the standard ASTM D445 ranging from 2 to 150 cSt, preferably ranging from 5 to 15 cSt. The lubricating oils can range from grade SAE 15 to grade SAE 250, and preferably from grade SAE 20W to grade SAE 50 (SAE means Society of Automotive Engineers).

Polydiol Statistical Copolymers (Statistical Copolymer A1)

The composition of the invention comprises at least one polydiol statistical copolymer resulting from the copolymerization of at least one first monomer M1 bearing diol functions and at least one second monomer M2, of different chemical structure to that of the monomer M1.

By "copolymer", is meant an oligomer or a linear or branched macromolecule having a sequence constituted by several repetitive units (or monomer unit) at least two units of which have a different chemical structure.

By "monomer unit" or "monomer", is meant a molecule capable of being converted to an oligomer or a macromolecule by association with itself or with of other molecules of the same type. A monomer denotes the smallest constitutive unit the repetition of which leads to an oligomer or to a macromolecule.

By "statistical copolymer", is meant an oligomer or a macromolecule in which the sequential distribution of the monomer units obeys known statistical laws. For example, a copolymer is said to be statistical when it is constituted by monomer units the distribution of which is a Markovian distribution. A diagrammatic statistical polymer (P1) is shown in FIG. 1. The distribution in the polymer chain of the monomer units depends on the reactivity of the polymerizable functions of the monomers and on the relative concentration of the monomers. The polydiol statistical copolymers of the invention are distinguished from the block copolymers and from the gradient copolymers. By "block" is meant a part of a copolymer comprising several identical or different monomer units which has at least one feature of its constitution or configuration making it possible to distinguish it from its adjacent parts. A diagrammatic block copolymer (P3) is shown in FIG. 1. A gradient copolymer denotes a copolymer of at least two monomer units of different structures the monomer composition of which changes in a gradual fashion along the polymer chain, thus passing progressively from one end of the polymer chain rich in one monomer unit, to the other end rich in the other comonomer. A diagrammatic gradient polymer (P2) is shown in FIG. 1.

By "copolymerization", is meant a process which allows a mixture of at least two monomer units of different chemical structures to be converted to an oligomer or to a copolymer.

In the remainder of the present application, "B" represents a boron atom.

By "$C_i$-$C_j$ alkyl" is meant a saturated, linear or branched hydrocarbon-containing chain comprising from i to j carbon atoms. For example, by "$C_1$-$C_{10}$ alkyl", is meant a saturated, linear or branched, hydrocarbon-containing chain comprising from 1 to 10 carbon atoms.

By "$C_6$-$C_{18}$ aryl", is meant a functional group which derives from an aromatic hydrocarbon-containing compound comprising from 6 to 18 carbon atoms. This functional group can be monocyclic or polycyclic. By way of illustration, a $C_6$-$C_{18}$ aryl can be phenyl, naphthalene, anthracene, phenanthrene and tetracene.

By "$C_2$-$C_{10}$" alkenyl, is meant a linear or branched hydrocarbon-containing chain comprising at least one unsaturation, preferably a double bond, and comprising from 2 to 10 carbon atoms.

By "$C_7$-$C_{18}$ aralkyl", is meant an aromatic hydrocarbon-containing compound, preferably monocyclic, substituted by at least one linear or branched alkyl chain and of which the total number of carbon atoms of the aromatic ring and of its substituents ranges from 7 to 18 carbon atoms. By way of illustration a $C_7$-$C_{18}$ aralkyl can be selected from the group formed by benzyl, tolyl and xylyl.

By "$C_6$-$C_{18}$ aryl group substituted by an $R'_3$ group", is meant an aromatic hydrocarbon-containing compound, preferably monocyclic, comprising from 6 to 18 carbon atoms of which at least one carbon atom of the aromatic ring is substituted by an $R'_3$ group.

By "Hal" or "halogen" is meant a halogen atom selected from the group formed by chlorine, bromine, fluorine and iodine.

Monomer M1

The first monomer M1 of the polydiol statistical copolymer (A1) of the invention has the general formula (I):

(I)

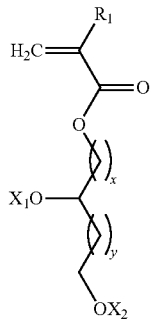

in which:

$R_1$ is selected from the group formed by —H, —$CH_3$ and —$CH_2$—$CH_3$, preferably —H and —$CH_3$;

x is an integer ranging from 2 to 18; preferably of 3 to 8; more preferably x is equal to 4;

y is an integer equal to 0 or 1; preferably y is equal to 0;

$X_1$ and $X_2$, identical or different, are selected from the group formed by hydrogen, tetrahydropyranyl, methyloxymethyl, ter-butyl, benzyl, trimethylsilyl and t-butyl dimethylsilyl;

$X_1$ and $X_2$, identical or different, are selected from the group formed by hydrogen, the tetrahydropyranyl, methyloxymethyl, the ter-butyl, the benzyl, the trimethylsilyl and the t-butyl dimethylsilyl;

or $X_1$ and $X_2$ form with the oxygen atoms a bridge of the following formula

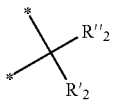

in which:

the stars (*) symbolize the bonds to the oxygen atoms, $R'_2$ and $R''_2$, identical or different, are selected from the group formed by hydrogen and a $C_1$-$C_{11}$ alkyl group;

or $X_1$ and $X_2$ form with the oxygen atoms a boronic ester of the following formula:

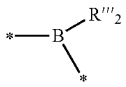

in which:

the stars (*) symbolize the bonds to the oxygen atoms, $R'''_2$ is selected from the group formed by a $C_6$-$C_{18}$ aryl, a $C_7$-$C_{18}$ aralkyl and a $C_2$-$C_{18}$ alkyl, preferably a $C_6$-$C_{18}$ aryl, more preferably phenyl.

Preferably, when $R'_2$ and $R''_2$ is a $C_1$-$C_{11}$ alkyl group; the hydrocarbon-containing chain is a linear chain. Preferably, the $C_1$-$C_{11}$ alkyl group is selected from the group formed by methyl, ethyl, n-propyl, n-butyl, n-pentyl, n-hexyl, n-heptyl, n-octyl, n-nonyl, n-decycl and n-undecyl. More preferably, the $C_1$-$C_{11}$ alkyl group is methyl. Preferably, when $R'''_2$ is a $C_2$-$C_{18}$ alkyl group; the hydrocarbon-containing chain is a linear chain.

Among the monomers of formula (I), the monomers corresponding to formula (I-A) form part of those preferred:

(I-A)

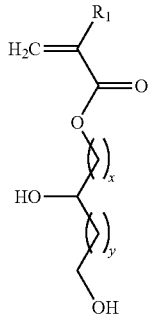

in which:

$R_1$ is selected from the group formed by —H, —$CH_3$ and —$CH_2$—$CH_3$, preferably —H and —$CH_3$;

x is an integer ranging from 2 to 18; preferably from 3 to 8; more preferably x is equal to 4;

y is an integer equal to 0 or 1; preferably y is equal to 0.

Among the monomers of formula (I), the monomers corresponding to formula (I-B) form part of those preferred:

(I-B)

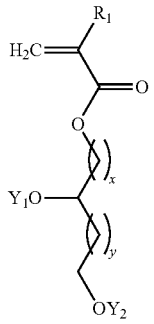

in which:

$R_1$ is selected from the group formed by —H, —$CH_3$ and —$CH_2$—$CH_3$, preferably —H and —$CH_3$;

x is an integer ranging from 2 to 18; preferably from 3 to 8; more preferably x is equal to 4;

y is an integer equal to 0 or 1; preferably y is equal to 0;

$Y_1$ and $Y_2$, identical or different, are selected from the group formed by tetrahydropyranyl, methyloxymethyl, ter-butyl, benzyl, trimethylsilyl and t-butyl dimethylsilyl;

or $Y_1$ and $Y_2$ form with the oxygen atoms a bridge of the following formula:

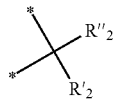

in which:

the stars (*) symbolize the bonds to the oxygen atoms, $R'_2$ and $R''_2$, identical or different, are selected from the group formed by hydrogen and a $C_1$-$C_{11}$ alkyl group;

or $Y_1$ and $Y_2$ form with the oxygen atoms a boronic ester of the following formula:

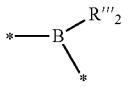

in which:

the stars (*) symbolize the bonds to the oxygen atoms, $R'''_2$ is selected from the group formed by a $C_6$-$C_{18}$ aryl, a $C_7$-$C_{18}$ aralkyl and a $C_2$-$C_{18}$ alkyl, preferably a $C_6$-$C_{18}$ aryl, more preferably phenyl.

Preferably, when $R'_2$ and $R''_2$ is a $C_1$-$C_{11}$ alkyl group; the hydrocarbon-containing chain is a linear chain. Preferably, the $C_1$-$C_{11}$ alkyl group is selected from the group formed by methyl, ethyl, n-propyl, n-butyl, n-pentyl, n-hexyl, n-heptyl, n-octyl, n-nonyl, n-decycl and n-undecyl. More preferably, the $C_1$-$C_{11}$ alkyl group is methyl. Preferably, when $R'''_2$ is a $C_2$-$C_{18}$ alkyl group; the hydrocarbon-containing chain is a linear chain.

Obtaining the Monomer M1

The monomer M1 of general formula (I-A) is obtained by deprotection of the alcohol functions of the monomer of general formula (I-B) according to the reaction diagram 1 below:

Diagram 1

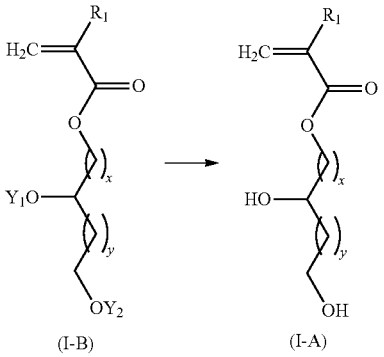

with $R_1$, $Y_1$, $Y_2$, x and y as defined in the general formula (IB) described above.

The deprotection reaction of diol functions of the monomer of general formula (I-B) is well known to a person skilled in the art. He knows how to adapt the deprotection reaction conditions as a function of the nature of the protective groups $Y_1$ and $Y_2$.

The monomer M1 of general formula (I-B) can be obtained by a reaction of a compound of general formula (I-c) with an alcohol compound of general formula (I-b) according to the reaction diagram 2 below:

Diagram 2

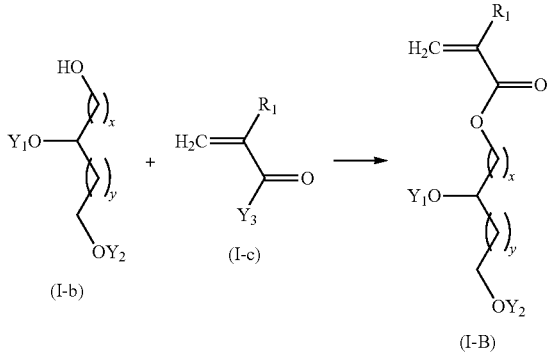

in which $Y_3$ is selected from the group formed by a halogen atom, preferably chlorine, —OH and O—C(O)—R', with $R'_1$ selected from the group formed by —H, —$CH_3$ and —$CH_2$—$CH_3$, preferably —H and —$CH_3$;

$R_1$, $Y_1$, $Y_2$, x and y have the same meaning as that given in general formula (I-B).

These coupling reactions are well known to a person skilled in the art. The compound of general formula (I-c) is commercially available from the suppliers: Sigma-Aldrich® and Alfa Aesar®.

The alcohol compound of general formula (I-b) is obtained from the corresponding polyol of formula (I-a) by protection of the diol functions according to the following reaction diagram 3:

Diagram 3

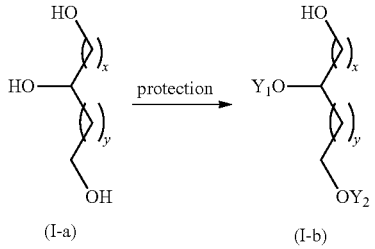

with x, y, $Y_1$ and $Y_2$ as defined in the general formula (I-B).

The protection reaction of the diol functions of the compound of general formula (I-a) is well known to a person skilled in the art. He knows how to adapt the deprotection reaction conditions as a function of the nature of the protective groups $Y_1$ and $Y_2$ used. The polyol of general formula (I-a) is commercially available from the suppliers: Sigma-Aldrich® and Alfa Aesar®.

Monomer M2

The second monomer of the statistical copolymer of the invention has the general formula (II):

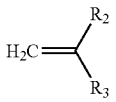

(II)

in which:

$R_2$ is selected from the group formed by —H, —$CH_3$ and —$CH_2$—$CH_3$, preferably —H or —$CH_3$, $R_3$ is selected from the group formed by a hydrogen atom, a $C_1$-$C_{10}$ alkyl group, a $C_2$-$C_{10}$ alkenyl group, a $C_6$-$C_{18}$ aryl group, a $C_6$-$C_{18}$ aryl substituted by an $R'_3$, —C(O)—O—$R'_3$; —O—$R'_3$, —S—$R'_3$ and —C(O)—N(H)—$R'_3$ group with $R'_3$ a $C_1$-$C_{30}$ alkyl group.

Preferably, $R'_3$ is a $C_1$-$C_{30}$ alkyl group of which the hydrocarbon-containing chain is linear.

Among the monomers of formula (II), the monomers corresponding to formula (II-A) form part of those preferred (II-A)

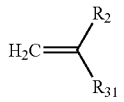

in which:

$R_2$ is selected from the group formed by —H, —$CH_3$ and —$CH_2$—$CH_3$, preferably —H or —$CH_3$, $R_{31}$ is selected from the group formed by a $C_6$-$C_{18}$ aryl group, a $C_6$-$C_{18}$ aryl substituted by an $R'_3$, —C(O)—O—$R'_3$, —O—$R'_3$, —S—$R'_3$ and —C(O)—N(H)—$R'_3$ group with $R'_3$ a $C_1$-$C_{30}$ alkyl group.

Preferably, $R'_3$ is a $C_1$-$C_{30}$ alkyl group of which the hydrocarbon-containing chain is linear.

Among the monomers of formula (II-A), the monomers corresponding to formula (II-A1)) form part of those preferred:

(II-A1)

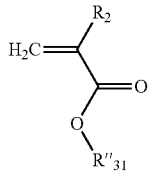

in which:

$R_2$ is selected from the group formed by —H, —$CH_3$ and —$CH_2$—$CH_3$, preferably —H and —$CH_3$, $R''_{31}$ is a $C_1$-$C_{14}$ alkyl group.

By "$C_1$-$C_{14}$ alkyl group", is meant a saturated, linear or branched hydrocarbon-containing chain comprising from 1 to 14 carbon atoms. Preferably, the hydrocarbon-containing chain is linear. Preferably, the hydrocarbon-containing chain comprises from 4 to 12 carbon atoms.

Among the monomers of formula (II-A), the monomers corresponding to formula (II-A2) also form part of those preferred:

(II-A2)

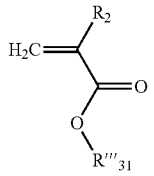

in which:

$R_2$ is selected from the group formed by —H, —$CH_3$ and —$CH_2$—$CH_3$, preferably —H and —$CH_3$, $R'''_{31}$ is a $C_{15}$-$C_{30}$ alkyl group.

By "$C_{15}$-$C_{30}$ alkyl group", is meant a saturated, linear or branched hydrocarbon-containing chain comprising from 15 to 30 carbon atoms. Preferably, the hydrocarbon-containing chain is linear. Preferably, the hydrocarbon-containing chain comprises from 16 to 24 carbon atoms.

Among the monomers of formula (II); the monomers corresponding to formula (II-B) form part of those preferred:

(II-B)

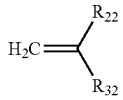

in which:

$R_{22}$ is selected from the group formed by H and $CH_3$;

$R_{32}$ is selected from the group formed by a hydrogen atom, a $C_1$-$C_{10}$ alkyl group and a $C_2$-$C_{10}$ alkenyl group.

Obtaining the Monomer M2

The monomers of formula (II), (II-A), in particular (II-A1) and (II-A2), (II-B) are well known to a person skilled in the art. They are marketed by Sigma-Aldrich® and TCI®.

Preferred Polydiol Copolymers

In an embodiment, a preferred statistical copolymer results from the copolymerization of at least:

- a first monomer M1 of general formula (I) as described previously;
- a second monomer M2 of formula (II) as described previously, in which $R_2$ is -H and $R_3$ is a $C_6$-$C_{18}$ aryl group; preferably $R_3$ is phenyl.

In another embodiment, a preferred statistical copolymer results from the copolymerization of at least:

- a first monomer M1 of general formula (I) as described previously;
- a second monomer M2 of formula (II-A1) as described previously; and
- a third monomer M2 of formula (II-A2) as described previously.

According to this other embodiment, a preferred statistical copolymer results from the copolymerization of at least:

- a first monomer M1 of general formula (I) as described previously;
- a second monomer M2 of formula (II-A1) in which $R_2$ is $CH_3$ and $R''_{31}$ is a $C_4$-$C_{12}$ alkyl group, preferably a linear $C_4$-$C_{12}$ alkyl;
- a third monomer M2 of formula (II-A2) in which $R_2$ is $CH_3$ and $R'''_{31}$ is a $C_{16}$-$C_{24}$ alkyl group, preferably a linear in $C_{16}$-$C_{24}$ alkyl.

According to this embodiment, a preferred statistical copolymer results from the copolymerization of at least:

- a first monomer M1 of general formula (I) as described previously;
- a second monomer M2 selected from the group formed by n-octyl methacrylate, n-decyl methacrylate and n-dodecyl methacrylate;
- a third monomer M2 selected from the group formed by palmityl methacrylate, stearyl methacrylate, arachidyl methacrylate and behenyl methacrylate.

In another embodiment, a preferred statistical copolymer results from the copolymerization of at least:

- a first monomer M1 of general formula (I) as defined previously;

a second monomer M2 of formula (II-B) as defined previously, in which $R_{22}$ and $R_{32}$ are a hydrogen atom;

a third monomer M2 of formula (II-B) as defined previously in which $R_{22}$ is a hydrogen atom, $R_{32}$ is a $C_1$-$C_{10}$ alkyl group, preferably $R_{32}$ a linear $C_1$-$C_{10}$ alkyl group, preferably $R_{32}$ is selected from the group constituted by $CH_3$, $CH_2$—$CH_3$, $CH_2$—$CH_2$—$CH_3$, $CH_2$—$(CH_2)_2$—$CH_3$ and $CH_2$—$(CH_2)_3$—$CH_3$.

According to this embodiment, a preferred statistical copolymer results from the copolymerization of at least:

a first monomer M1 of general formula (I) as defined previously;

a second monomer M2 of formula (II-B) which is ethylene;

a third monomer M2 of formula (II-B) which is propylene.

In another embodiment, a preferred statistical copolymer results from a copolymerization step of at least:

a first monomer M1 of general formula (I) as defined previously;

a second monomer M2 of general formula (II-B) as defined previously, in which $R_{22}$ is a hydrogen atom and $R_{32}$ is selected from the group formed by a hydrogen and a $C_1$-$C_{10}$ alkyl group;

a third monomer M2 of general formula (II-A1) as defined previously.

In another embodiment, a preferred statistical copolymer results from a copolymerization step of at least:

a first monomer M1 of general formula (I) as described previously;

a second monomer M2 of formula (II) as described previously, in which $R_2$ is H and $R_3$ is a $C_6$-$C_{18}$ aryl group; preferably $R_3$ is phenyl; and a third monomer M2 of formula (II-B) as described previously, in which $R_{22}$ is selected from the group formed by H or $CH_3$, $R_{32}$ is a $C_2$-$C_{10}$ alkenyl group, preferably $R_{32}$ is —C(H)═CH2;

and a hydrogenation step.

Hydrogenation can be accomplished by any technique well known to a person skilled in the art.

Process for Obtaining the Polydiol Copolymers

A person skilled in the art is in a position to synthesize the polydiol statistical copolymers A1 of the invention by calling on his general knowledge. The copolymerization can be initiated in by bulk polymerization or in solution in an organic solvent by compounds that generate free radicals. For example, the copolymers of the invention, in particular those resulting from the copolymerization of at least one monomer of formula (I) with at least one monomer of formula (II-A) or of at least one monomer of formula (I) with at least one monomer of formula (II-A1) and at least one monomer of formula (II-A2), are obtained by the processes known as radical copolymerization, in particular controlled radical copolymerization, such as the method called radical copolymerization controlled by Reversible Addition-Fragmentation Chain Transfer (RAFT) and the method called radical copolymerization controlled by Atom Transfer Radical Polymerization (ARTP). Conventional radical polymerization and telomerization can also be used for the preparation of the copolymers of the invention (Moad, G.; Solomon, D. H., The Chemistry of Radical Polymerization. 2nd ed.; Elsevier Ltd: 2006; p 639; Matyaszewski, K.; Davis, T. P. Handbook of Radical Polymerization; Wiley-Interscience: Hoboken, 2002; p 936).

A process for the preparation of a statistical copolymer comprises at least one polymerization step (a) in which at least the following are brought into contact:

i) a first monomer M1 of general formula (I):

(I)

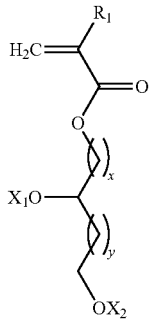

in which:

$R_1$ is selected from the group formed by —H, —$CH_3$ and —$CH_2$—$CH_3$;

x is an integer ranging from 2 to 18;

y is an integer equal to 0 or 1;

$X_1$ and $X_2$, identical or different, are selected from the group formed by hydrogen, tetrahydropyranyl, methyloxymethyl, ter-butyl, benzyl, trimethylsilyl and t-butyl dimethylsilyl;

or $X_1$ and $X_2$ form with the oxygen atoms a bridge of following formula

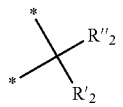

in which:

the stars (.) symbolize the bonds to the oxygen atoms;

$R'_2$ and $R''_2$, identical or different, are selected from the group formed by hydrogen and a $C_1$-$C_{11}$ alkyl, preferably methyl;

or $X_1$ and $X_2$ form with the oxygen atoms a boronic ester of the following formula

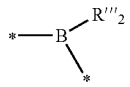

in which:

the stars (*) symbolize the bonds to the oxygen atoms;

$R'''_2$ is selected from the group formed by a $C_6$-$C_{18}$ aryl, a $C_7$-$C_{18}$ aralkyl and $C_2$-$C_{18}$ alkyl, preferably a $C_6$-$C_{18}$ aryl ii) at least one second monomer M2 of general formula (II-A):

(II)

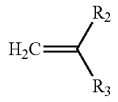

in which:

$R_2$ is selected from the group formed by —H, —$CH_3$ and —$CH_2$—$CH_3$, $R_3$ is selected from the group formed by a $C_6$-$C_{18}$ aryl, a $C_6$-$C_{18}$ aryl substituted by an $R'_3$, —S—$R'_3$ and —C(O)—N(H)—$R'_3$ group with $R'_3$ a $C_1$-$C_{30}$ alkyl;

iii) at least one source of free radicals.

In an embodiment, the process can comprise moreover iv) at least one chain-transfer agent.

By "a source of free radicals" is meant a chemical compound or making it possible to generate a chemical species having one or more electrons which are not paired in its outer shell. A person skilled in the art can use any source of free radicals known per se such as suitable for the polymerization processes, in particular controlled radical polymerization. Among the sources of free radicals, the following are preferred, by way of illustration: benzoyl peroxide, tert-butyl peroxide, the diazo compounds such as azo-bis-iso-butyronitrile, the peroxygenated compounds such as persulphates or hydrogen peroxide, the redox systems such as the oxidation of $Fe^{2+}$, the persulphates/sodium-metabisulphite mixtures, or ascorbic acid/hydrogen peroxide mixtures or also the compounds which can be cleaved photochemically or by ionizing radiation, for example ultraviolet rays or by beta or gamma radiation.

By "chain-transfer agent", is meant a compound the goal of which is to ensure homogeneous growth of the macromolecular chains by transfer reactions which are reversible between species during growth, i.e. polymer chains terminated by a carbon radical, and dormant species, i.e. polymer chains terminated by a transfer agent. This reversible transfer process makes it possible to control the molecular masses of copolymers thus prepared. Preferably in the process of the invention, the chain-transfer agent comprises a thiocarbonylthio group —S—C(═S)—. By way of illustration of a chain-transfer agent, the dithioesters, trithiocarbonates, xanthates and dithiocarbamates can be mentioned. A preferred transfer agent is cumyl dithiobenzoate or 2-cyano-2-propyl benzodithioate.

By "chain-transfer agent", is also meant a compound the goal of which is to limit the growth of the macromolecular chains during formation by the addition of monomer molecules and to initiate of new chains, which makes it possible to limit the final molecular masses, or even to control them. Such a type of transfer agent is used in telomerization. A preferred transfer agent is cysteamine.

The process for the preparation of a polydiol statistical copolymer can comprise:

at least one step of polymerization (a) as defined above, in which the monomers M1 and M2 are selected with $X_1$ and $X_2$ different from hydrogen, and moreover at least one step of deprotection (b) of the diol functions of the copolymer obtained at the end of step (a), so as to obtain a copolymer in which $X_1$ and $X_2$ are identical and are a hydrogen atom.

In an embodiment, the polymerization step (a) comprises the bringing into contact of at least one monomer M1 with at least two monomers M2 having different $R_{31}$ groups. In this embodiment, one of the monomers M2 has the general formula (II-A1):

(II-A1)

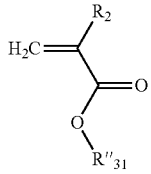

in which:

$R_2$ is selected from the group formed by —H, —$CH_3$ and —$CH_2$—$CH_3$, preferably —H and —$CH_3$, $R''_{31}$ is a $C_1$-$C_{14}$ alkyl group;

and the other monomer M2 has the general formula (II-A2)

(II-A2)

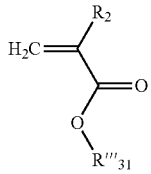

in which:

$R_2$ is selected from the group formed by —H, —$CH_3$ and —$CH_2$—$CH_3$, preferably —H and —$CH_3$, $R'''_{31}$ is a $C_{15}$-$C_{30}$ alkyl group.

The preferences and definitions described for the general formulae (I), (I-A), (I-B), (II-A), (I-B), (II-A), (II-A1) and (II-A2) apply also to the processes described above.

Properties of the Polydiol Copolymers A1

Figure 2:
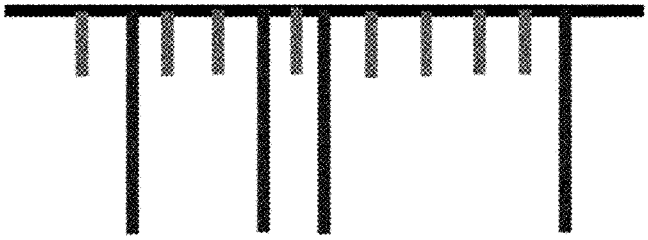
FIG. 2 shows diagrammatically a comb copolymer.

The polydiol statistical copolymers A1 of the invention are comb copolymers. By "comb copolymers", is meant a copolymer having a main chain (also called backbone) and side chains. The side chains are pendant on both sides of the main chain. The length of each side chain is less than the length of the main chain. FIG. 2 diagrammatically shows a comb polymer.

The copolymers of the invention in particular those resulting from the copolymerization of at least one monomer of formula (I) with at least one monomer of formula (II-A) or of at least one monomer of formula (I) with at least one monomer of formula (II-A1) and at least one monomer of formula (II-A2), have a backbone of polymerizable functions, in particular a backbone of methacrylate functions, and a mixture of hydrocarbon-containing side chains substituted or not by diol functions. As the monomers of formula (I) and (II-A) have polymerizable functions of identical or substantially identical reactivity, a copolymer is obtained the monomers of which, having diol functions, are distributed statistically along the backbone of the copolymer with respect to the monomers the alkyl chains of which are non-substituted by diol functions.

The polydiol statistical copolymers of the invention, in particular those resulting from the copolymerization of at least one monomer of formula (I) with at least one monomer of formula (II-A) or of at least one monomer of formula (I) with at least one monomer of formula (II-A1) and at least one monomer of formula (II-A2), have the advantage of being sensitive to external stimuli, such as the temperature, pressure, shear rate; this sensitivity being demonstrated by a change in properties. In response to a stimulus, the spatial conformation of the copolymer chains is modified and the diol functions are rendered more accessible or less accessible to the association reactions capable of generating cross-linking, as well as to the exchange reactions. These association and exchange processes are reversible. The copolymer of the invention A1 is a thermosensitive copolymer, i.e. it is sensitive to changes in temperature.

Advantageously, the side chains of the polydiol statistical copolymer, in particular that resulting from the copolymerization of at least one monomer of formula (I) with at least one monomer of formula (II-A) or of at least one monomer of formula (I) with at least one monomer of formula (II-A1) and at least one monomer of formula (II-A2), have an average length ranging from 8 to 20 carbon atoms, preferably from 9 to 15 carbon atoms. By "average length of side chain" is meant the average length of the side chains of each monomer constituting the copolymer. A person skilled in the art knows how to obtain this average length by appropriately selecting the types and the ratio of monomers constituting the polydiol statistical copolymer. The choice of this average chain length makes it possible to obtain a polymer which is soluble in a hydrophobic medium, whatever the temperature at which the copolymer is dissolved. The copolymer A1 is therefore miscible in a hydrophobic medium. By "hydrophobic medium" is meant a medium which has no or very little affinity for water, i.e. it is not miscible in water or in an aqueous medium. Advantageously, the polydiol statistical copolymer of the invention, in particular that resulting from the copolymerization of at least one monomer of formula (I) with at least one monomer of formula (II-A) or of at least one monomer of formula (I) with at least one monomer of formula (II-A1) and at least one monomer of formula (II-A2), has a molar percentage of monomer M1 of formula (I) in said copolymer ranging from 1 to 30%, preferably ranging from 5 to 25%, more preferably ranging from 9 to 21%.

In a preferred embodiment of the invention, the copolymer of the invention has a molar percentage of monomer M1 of formula (I) in said copolymer ranging from 1 to 30%, preferably 5 to 25%, more preferably ranging from 9 to 21%, a molar percentage of monomer M2 of formula (II-A1) in said copolymer ranging from 8 to 92% and a molar percentage of monomer M2 of formula (II-A2) in said copolymer ranging from 0.1 to 62%. The molar percentage of monomers in the copolymer results directly from adjustment of the quantities of monomers utilized for the synthesis of the copolymer. In a preferred embodiment, the copolymer A1 has a molar percentage of monomer M1 of formula (I) in said copolymer ranging from 1 to 30%, a molar percentage of monomer M2 of formula (II-A) in said copolymer ranging from 8 to 62% and a molar percentage of monomer M2 of formula (II-B) in said copolymer ranging from 8 to 91%. The molar percentage of monomers in the copolymer results directly from adjustment of the quantities of monomers utilized for the synthesis of the copolymer.

Advantageously, the polydiol statistical copolymer of the invention, in particular that resulting from the copolymerization of at least one monomer of formula (I) with at least one monomer of formula (II-A) or of at least one monomer of formula (I) with at least one monomer of formula (II-A1) and at least one monomer of formula (II-A2), has a number-average degree of polymerization ranging from 100 to 2000, preferably from 150 to 1000. The degree of polymerization is controlled in a known way by using a controlled radical polymerization technique, a telomerization technique, or by adjusting the source quantity of free radicals when the copolymers of the invention are prepared by conventional radical polymerization.

Advantageously, the polydiol statistical copolymer of the invention, in particular that resulting from the copolymerization of at least one monomer of formula (I) with at least one monomer of formula (II-A) or of at least one monomer of formula (I) with at least one monomer of formula (II-A1) and at least one monomer of formula (II-A2), has a polydispersity index (PDI) ranging from 1.05 to 3.75; preferably ranging from 1.10 to 3.45. The polydispersity index is obtained by steric exclusion chromatography measurement using a polystyrene calibration. Advantageously, the polydiol statistical copolymer of the invention, in particular that resulting from the copolymerization of at least one monomer of formula (I) with at least one monomer of formula (II-A) or of at least one monomer of formula (I) with at least one monomer of formula (II-A1) and at least one monomer of formula (II-A2), has a number-average molar mass ranging from 10,000 to 400,000 g/mol, preferably from 25,000 to 150,000 g/mol, the number-average molar mass being obtained by steric exclusion chromatography measurement using a polystyrene calibration. The method of steric exclusion chromatography measurement using a polystyrene calibration is described in the work (Fontanille, M.; Gnanou, Y., Chimie et physico-chimie des polymères. 2nd ed.; Dunod: 2010; p 546).

Compound A2 Diboronic Ester

In an embodiment of the composition of the invention, the compound A2 comprising two boronic ester functions has the general formula (III):

(III)

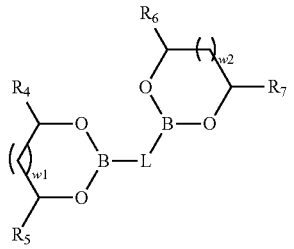

in which:

$w_1$ and $w_2$, identical or different, are integers selected between 0 and 1, $R_4$, $R_5$, $R_6$ and $R_7$, identical or different, are selected from the group formed by hydrogen and a hydrocarbon-containing group having from 1 to 24 carbon atoms, preferably from 4 to 18 carbon atoms, preferably from 6 to 14 carbon atoms;

L is a divalent bond group and selected from the group formed by a $C_6$-$C_{18}$ aryl, a $C_7$-$C_{24}$ aralkyl and a $C_2$-$C_{24}$ hydrocarbon-containing chain, preferably a $C_6$-$C_{18}$ aryl.

By "hydrocarbon-containing group having from 1 to 24 carbon atoms" is meant a linear or branched alkyl or alkenyl group, having from 1 to 24 carbon atoms. Preferably, the hydrocarbon-containing group comprises from 4 to 18 carbon atoms, preferably from 6 to 14 carbon atoms. Preferably, the hydrocarbon-containing group is a linear alkyl.

By "$C_2$-$C_{24}$ hydrocarbon-containing chain" is meant a linear or branched alkyl or alkenyl group, comprising from 2 to 24 carbon atoms. Preferably, the hydrocarbon-containing chain is a linear alkyl group. Preferably the hydrocarbon-containing chain comprises from 6 to 16 carbon atoms.

In an embodiment of the invention, the compound A2 is a compound of general formula (III) above in which:

$w_1$ and $w_2$, identical or different, are integers selected between 0 and 1;

$R_4$ and $R_6$ are identical and are hydrogen atoms;

$R_5$ and $R_7$ are identical and are a hydrocarbon-containing group, preferably a linear alkyl, having from 1 to 24 carbon atoms, preferably from 4 to 18 carbon atoms, preferably from 6 to 16 carbon atoms;

L is a divalent bond group and is a $C_6$-$C_{18}$ aryl, preferably phenyl.

The boronic diester compound A2 of formula (III) as described above is obtained by a condensation reaction between a boronic acid of general formula (III-a) and diol functions of the compounds of general formula (III-b) and (III-c) according to the reaction diagram 4 below:

Diagram 4

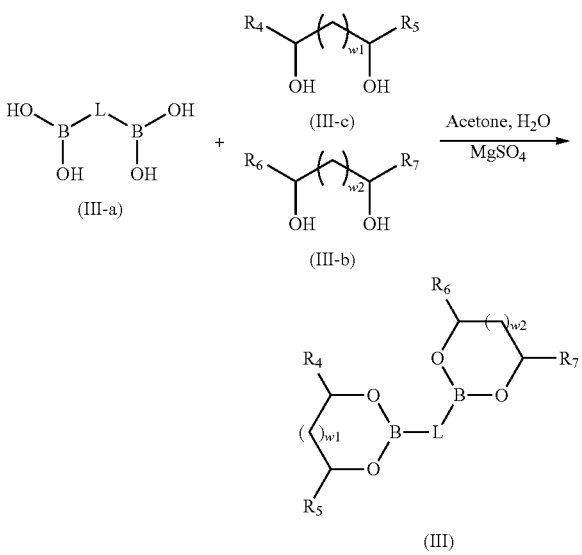

with $w_1$, $w_2$, L, $R_4$, $R_5$, $R_6$ and $R_7$, as defined above.

Indeed, by condensation of the boronic acid functions of the compound (III-a) with diol functions of the compounds of formula (III-b) and of formula (III-c), compounds having two boronic ester functions are obtained (compound of formula (III)). This step is carried out according to means well known to a person skilled in the art.

Within the context of the present invention, the compound of general formula (III-a) is dissolved, in the presence of water, in a polar solvent such as acetone. The presence of water allows the chemical equilibria between the molecules of boronic acid of formula (III-a) and the boroxine molecules obtained from the boronic acids of formula (III-a) to be shifted. In fact, it is well known that the boronic acids can spontaneously form boroxine molecules at ambient temperature. Now, the presence of boroxine molecules is undesirable within the context of the present invention.

The condensation reaction is carried out in the presence of a dehydration agent such as magnesium sulphate. This agent makes it possible to trap the water molecules initially introduced as well as those that are released by the condensation between the compound of formula (III-a) and the compound of formula (III-b) and between the compound of formula (III-a) and the compound of formula (III-c). In an embodiment, the compound (III-b) and the compound (III-c) are identical. A person skilled in the art knows how to adapt the quantities of reagents of formula (III-b) and/or (III-c) and of formula (III-a) in order to obtain the product of formula (III).

Compound A2 Boronic Ester Copolymer

In another embodiment of the composition of the invention, the compound A2 comprising at least two boronic ester functions is a boronic ester statistical copolymer resulting from the copolymerization of at least one monomer M3 of formula (IV) as described below with at least one monomer M4 of formula (V) as described below.

Monomer M3 of Formula (IV)

The monomer M3 of the boronic ester statistical copolymer compound A2 has the general formula (IV) in which:

(IV)

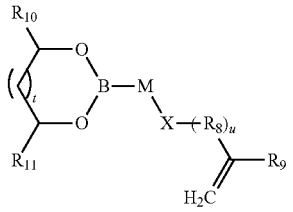

in which:

t is an integer equal to 0 or 1;

u is an integer equal to 0 or 1;

M and $R_8$ are divalent bond groups, identical or different, and are selected from the group formed by a $C_6$-$C_{18}$ aryl, a $C_7$-$C_{24}$ aralkyl and $C_2$-$C_{24}$ alkyl, preferably a $C_6$-$C_{18}$ aryl, X is a function selected from the group formed by —O—C(O)—, —C(O)—O—, —C(O)—N(H)—, —N(H)—C(O)—, —S—, —N(H)—, —N($R'_4$)— and —O— with $R'_4$ a hydrocarbon-containing chain comprising from 1 to 15 carbon atoms;

$R_9$ is selected from the group formed by —H, —$CH_3$ and —$CH_2$—$CH_3$; preferably —H and —$CH_3$;

$R_{10}$ and $R_{11}$, identical or different, are selected from the group formed by hydrogen and a hydrocarbon-containing chain having from 1 to 24 carbon atoms, preferably between 4 and 18 carbon atoms, preferably between 6 and 12 carbon atoms;

By "$C_2$-$C_{24}$ alkyl" is meant a saturated, linear or branched hydrocarbon-containing chain comprising from 2 to 24 carbon atoms. Preferably, the hydrocarbon-containing chain is linear. Preferably the hydrocarbon-containing chain comprises from 6 to 16 carbon atoms.

By "hydrocarbon-containing chain comprising from 1 to 15 carbon atoms" is meant a linear or branched alkyl or alkenyl group, comprising from 1 to 15 carbon atoms. Preferably, the hydrocarbon-containing chain is a linear alkyl group. Preferably, it comprises from 1 to 8 carbon atoms.

By "hydrocarbon-containing chain comprising from 1 to 24 carbon atoms" is meant a linear or branched alkyl or alkenyl group, comprising from 1 to 24 carbon atoms. Preferably, the hydrocarbon-containing chain is a linear alkyl group. Preferably, it comprises from 4 to 18 carbon atoms, preferably between 6 and 12 carbon atoms.

In an embodiment of the invention, the monomer M3 has the general formula (IV) in which:

t is an integer equal to 0 or 1;

u is an integer equal to 0 or 1;

M and $R_8$ are divalent bond groups and are different, M is a $C_6$-$C_{18}$ aryl, preferably phenyl, $R_8$ is a $C_7$-$C_{24}$ aralkyl, preferably benzyl;

X is a function selected from the group formed by —O—C(O)—, —C(O)—O—, —C(O)—N(H)— and —O—, preferably —C(O)—O— or —O—C(O)—;

$R_9$ is selected from the group formed by —H, —$CH_3$, preferably —H;

$R_{10}$ and $R_{11}$ are different, one of the $R_{10}$ or $R_{11}$ groups is H and the other $R_{10}$ or $R_{11}$ group is a hydrocarbon-containing chain, preferably a linear alkyl group, having from 1 to 24 carbon atoms, preferably between 4 and 18 carbon atoms, preferably between 6 and 12 carbon atoms.

Synthesis of the Monomer M3 of Formula (IV)

In all the diagrams shown below, unless stated otherwise, the variables $R_{10}$, $R_{11}$, M, u, t, X, $R_8$, $R'_4$ and $R_9$ have the same definition as in formula (IV) above. The monomers M3 of formula (IV) are in particular obtained from a preparation process comprising at least one step of condensation of a boronic acid of general formula (IV-f) with a diol compound of general formula (IV-g) according to the reaction diagram 5 below:

Diagram 5

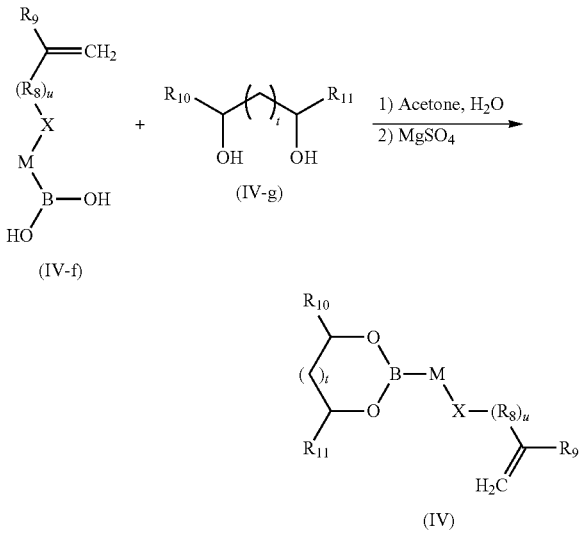

Indeed, by condensation of the boronic acid functions of the compound of formula (IV-f) with diol functions of the compounds of formula (IV-g), a boronic ester compound of formula (IV) is obtained. This step is carried out according to methods well known to a person skilled in the art. Within the context of the present invention, the compound of general formula (IV-f) is dissolved, in the presence of water, in a polar solvent such as acetone. The condensation reaction is carried out in the presence of a dehydration agent, such as magnesium sulphate. The compounds of formula (IV-g) are commercially available from the following suppliers: Sigma-Aldrich®, Alfa Aesar® and TCI®.

The compound of formula (IV-f) is obtained directly from the compound of formula (IV-e) by hydrolysis according to the following reaction diagram 6:

Diagram 6

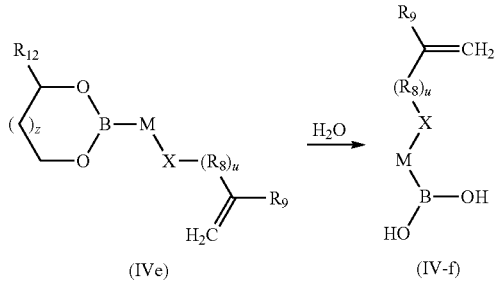

with z an integer equal to 0 or 1;

$R_{12}$ is selected from the group formed by —H, —$CH_3$ and —$CH_2$—$CH_3$;

u, X, M, $R_8$ and $R_9$ as defined above.

The compound of formula (IV-e) is obtained by a condensation reaction of a compound of formula (IV-c) with at least one compound of formula (IV-d) according to the following reaction diagram 7:

Diagram 7

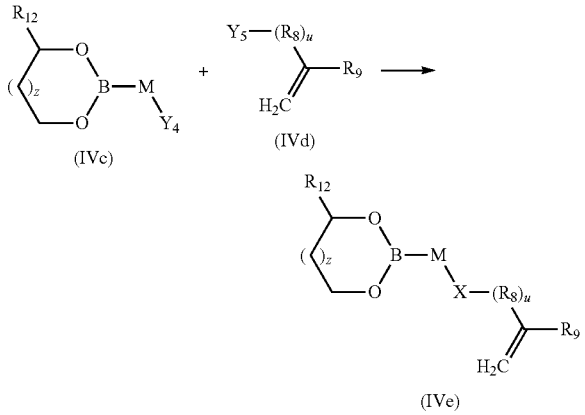

with z, $R_{12}$, M, $R'_4$, $R_9$ and $R_8$ as defined above;

and in this diagram when:

and in this diagram when:

X represents —O—C(O)—, then $Y_4$ represents an alcohol function —OH or a halogen atom, preferably chlorine or bromine and $Y_5$ is a carboxylic acid function —C(O)—OH;

X represents —C(O)—O—, then $Y_4$ represents a carboxylic acid function —C(O)—OH and $Y_5$ is an alcohol function —OH or a halogen atom, and preferably chlorine or bromine;

X represents —C(O)—N(H)—, then $Y_4$ represents a carboxylic acid function—C(O)—OH or a—C(O)—Hal function, and $Y_5$ is an amine function $NH_2$;

X represents —N(H)—C(O)—, then $Y_4$ represents an amine function $NH_2$ and $Y_5$ is a carboxylic acid function —C(O)—OH or a—C(O)—Hal function;

X represents —S—, then $Y_4$ is a halogen atom and $Y_5$ is a thiol function —SH or $Y_4$ is a thiol function —SH and $Y_5$ is a halogen atom;

X represents —N(H)—, then $Y_4$ is a halogen atom and $Y_5$ is an amine function —$NH_2$ or $Y_4$ is an amine function —$NH_2$ and $Y_5$ is a halogen atom;

X represents —N($R'_4$)—, then $Y_4$ is a halogen atom and $Y_5$ is an amine function —N(H)($R'_4$) or $Y_4$ is an amine function —N(H)($R'_4$) and $Y_5$ is a halogen atom;

X represents —O—, then $Y_4$ is a halogen atom and $Y_5$ is an alcohol function

—OH or $Y_4$ is an alcohol function —OH and $Y_5$ is a halogen atom.

These esterification, etherification, thioetherification, alkylation or condensation reactions between an amine function and a carboxylic acid function are well known to a person skilled in the art. A person skilled in the art therefore knows how to select the reaction conditions depending on the chemical nature of the $Y_1$ and $Y_2$ groups in order to obtain the compound of formula (IV-e). The compounds of formula (IV-d) are commercially available from the suppliers: Sigma-Aldrich® and TCI®.

The compound of formula (IV-c) is obtained by a condensation reaction between a boronic acid of formula (IV-a) with at least one diol compound of formula (IV-b) according to the following reaction diagram 8

Diagram 8

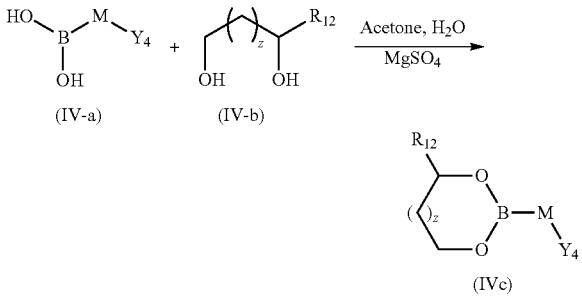

with M, $Y_4$, z and $R_{12}$ as defined above,

Among the compounds of formula (IV-b), the one in which R12 is methyl and z=0 is preferred. The compounds of formula (IV-a) and (IV-b) are commercially available from the following suppliers Sigma-Aldrich®, Alfa Aesar® and TCI®.

Monomer M4 of General Formula (V):

The monomer M4 of the boronic ester statistical copolymer compound A2 has the general formula (V (V)

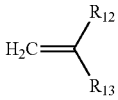

in which:

$R_{12}$ is selected from the group formed by —H, —$CH_3$ and —$CH_2$—$CH_3$, preferably —H and —$CH_3$;

$R_{13}$ is selected from the group formed by a $C_6$-$C_{18}$ aryl, a $C_6$-$C_{18}$ aryl substituted by an $R'_{13}$ group, —C(O)—O—$R'_{13}$; —O—$R'_{13}$, —S—$R'_{13}$and —C(O)—N(H)—$R'_{13}$with $R'_{13}$ a $C_1$-$C_{25}$ alkyl group.

By "$C_1$-$C_{25}$ alkyl group", is meant a saturated, linear or branched hydrocarbon-containing chain comprising from 1 to 25 carbon atoms. Preferably, the hydrocarbon-containing chain is linear.

By "$C_6$-$C_{18}$ aryl substituted by an $R_{13}$ group" group, is meant an aromatic hydrocarbon-containing compound comprising from 6 to 18 carbon atoms of which at least one carbon atom of the aromatic ring is substituted by a $C_1$-$C_{25}$ alkyl group as defined above.

Among the monomers of formula (V), the monomers corresponding to formula (V-A) are preferred:

(V-A)

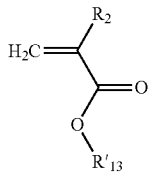

in which:

$R_2$ is selected from the group formed by —H, —$CH_3$ and —$CH_2$—$CH_3$ preferably —H and —$CH_3$, $R'_{13}$ a $C_1$-$C_{25}$ alkyl group, preferably a linear $C_1$-$C_{25}$ alkyl, yet more preferably a linear $C_5$-$C_{15}$ alkyl.

Obtaining the Monomer M4:

The monomers of formulae (V) and (V-A) are well known to a person skilled in the art. They are marketed by Sigma-Aldrich® and TCI®.

Synthesis of Boronic Ester Statistical Copolymer Compound A2

A person skilled in the art is in a position to synthesize the boronic ester statistical copolymers by calling on his general knowledge. The copolymerization can be initiated by bulk polymerization or in solution in an organic solvent by compounds generating free radicals. For example, the boronic ester statistical copolymers are obtained by the processes known as radical copolymerization, in particular controlled radical polymerization, such as the method called controlled radical copolymerization by Reversible Addition-Fragmentation Chain Transfer (RAFT) and the method called controlled radical polymerization by Atom Transfer Radical Polymerization (ARTP). Conventional radical polymerization and telomerization can also be used for the preparation of the copolymers of the invention (Moad, G.; Solomon, D. H., The Chemistry of Radical Polymerization. 2nd ed.; Elsevier Ltd: 2006; p 639; Matyaszewski, K.; Davis, T. P. Handbook of Radical Polymerization; Wiley-Interscience: Hoboken, 2002; p 936).

Thus another subject of the present invention is a process for the preparation of a boronic ester statistical copolymer comprises at least one polymerization step (a) in which at least the following are brought into contact:

i) a first monomer M3 of general formula (IV):

(IV)

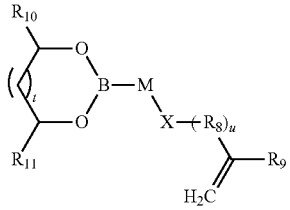

in which:

t is an integer equal to 0 or 1;

u is an integer equal to 0 or 1;

M and $R_8$ are divalent bond groups, identical or different, and are selected from the group formed by a $C_6$-$C_{18}$ aryl, a $C_7$-$C_{24}$ aralkyl and a $C_2$-$C_{24}$ alkyl, preferably a $C_6$-$C_{18}$ aryl; 'X is a function selected from the group formed by —O—C(O)—, —C(O)—O—, —C(O)—N(H)—, —N(H)—C(O)—, —S—, —N(H)—, —N(R'$_4$)— and —O— with R'$_4$ a hydrocarbon-containing chain comprising from 1 to 15 carbon atoms;

$R_9$ is selected from the group formed by —H, —$CH_3$ and —$CH_2$—$CH_3$; preferably —H and —$CH_3$;

$R_{10}$ and $R_{11}$, identical or different, are selected from the group formed by hydrogen and a hydrocarbon-containing chain having from 1 to 24 carbon atoms, preferably between 4 and 18 carbon atoms, preferably between 6 and 12 carbon atoms;

ii) at least one second monomer M4 of general formula (V):

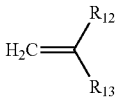

(V)

in which:

$R_{12}$ is selected from the group formed by —H, —$CH_3$ and —$CH_2$—$CH_3$, preferably —H —$CH_3$;

$R_{13}$ is selected from the group formed by a $C_6$-$C_{18}$ aryl, a $C_6$-$C_{18}$ aryl substituted by an R'$_{13}$, —C(O)—O—R'$_{13}$; —O—R'$_{13}$, —S—R'$_{13}$ and —C(O)—N(H)—R'$_{13}$ group with R'$_{13}$ a $C_1$-$C_{25}$ alkyl group.

iii) at least one source of free radicals.

In an embodiment, the process can comprise moreover iv) at least one chain-transfer agent. The preferences and definitions described for the general formulae (IV) and (V) also apply to the process. The sources of radicals and the transfer agents are those that have been described for the synthesis of polydiol statistical copolymers. The preferences described for the sources of radicals and of the transfer agents also apply to this process.

Properties of the Boronic Ester Statistical Copolymers Compounds A2

Advantageously, the chain formed by the sequence of the $R_{10}$, M, $(R_8)_u$ groups with u, an integer equal to 0 or 1, and X of the monomer M3 of general formula (IV) has a total number of carbon atoms ranging from 8 to 38, preferably ranging from 10 to 26. Advantageously, the side chains of the boronic ester statistical copolymer have an average length greater than 8 carbon atoms, preferably ranging from 11 to 16. This chain length makes it possible to solubilize the boronic ester statistical copolymer in a hydrophobic medium. By "average length of side chain" is meant the average length of the side chains of each monomer constituting the copolymer. A person skilled in the art knows how to obtain this average length by appropriately selecting the types and the ratio of monomers constituting the boronic ester statistical copolymer.

Advantageously, the boronic ester statistical copolymer has a molar percentage of monomer of formula (IV) in said copolymer ranging from 0.25 to 20%, preferably from 1 to 10%. Advantageously, the boronic ester statistical copolymer has a molar percentage of monomer of formula (IV) in said copolymer ranging from 0.25 to 20%, preferably from 1 to 10% and a molar percentage of monomer of formula (V) in said copolymer ranging from 80 to 99.75%, preferably from 90 to 99%. Advantageously, the boronic ester statistical copolymer has a number-average degree of polymerization ranging from 50 to 1500, preferably from 80 to 800.

Advantageously, the boronic ester statistical copolymer has a polydispersity index (PDI) ranging from 1.04 to 3.54; preferably ranging from 1.10 to 3.10. These values are obtained by steric exclusion chromatography using tetrahydrofuran as eluent and a polystyrene calibration. Advantageously, the boronic ester statistical copolymer has a number-average molar mass ranging from 10,000 to 200,000 g/mol preferably from 25,000 to 100,000 g/mol. These values are obtained by steric exclusion chromatography using tetrahydrofuran as eluent and a polystyrene calibration.

Characteristics of the Novel Compositions of the Invention

The novel compositions of the invention have the advantage of being cross-linkable in a thermoreversible manner. The polydiol statistical copolymers A1, in particular those resulting from the copolymerization of at least one monomer of formula (I) with at least one monomer of formula (II-A) or of at least one monomer of formula (I) with at least one monomer of formula (II-A1) and at least one monomer of formula (II-A2), and the compounds A2 as defined above have the advantage of being associative and of exchanging chemical bonds in a thermoreversible manner, in particular in a hydrophobic medium, in particular an apolar hydrophobic medium.

Under certain conditions, the polydiol statistical copolymers A1, in particular those resulting from the copolymerization of at least one monomer of formula (I) with at least one monomer of formula (II-A) or of at least one monomer of formula (I) with at least one monomer of formula (II-A1) and at least one monomer of formula (II-A2), and the compounds A2 as defined above can be cross-linked. The polydiol statistical copolymers A1, in particular those resulting from the copolymerization of at least one monomer of formula (I) with at least one monomer of formula (II-A) or of at least one monomer of formula (I) with at least one monomer of formula (II-A1) and at least one monomer of formula (II-A2), and the compounds A2 also have the advantage of being exchangeable.

Figure 4:
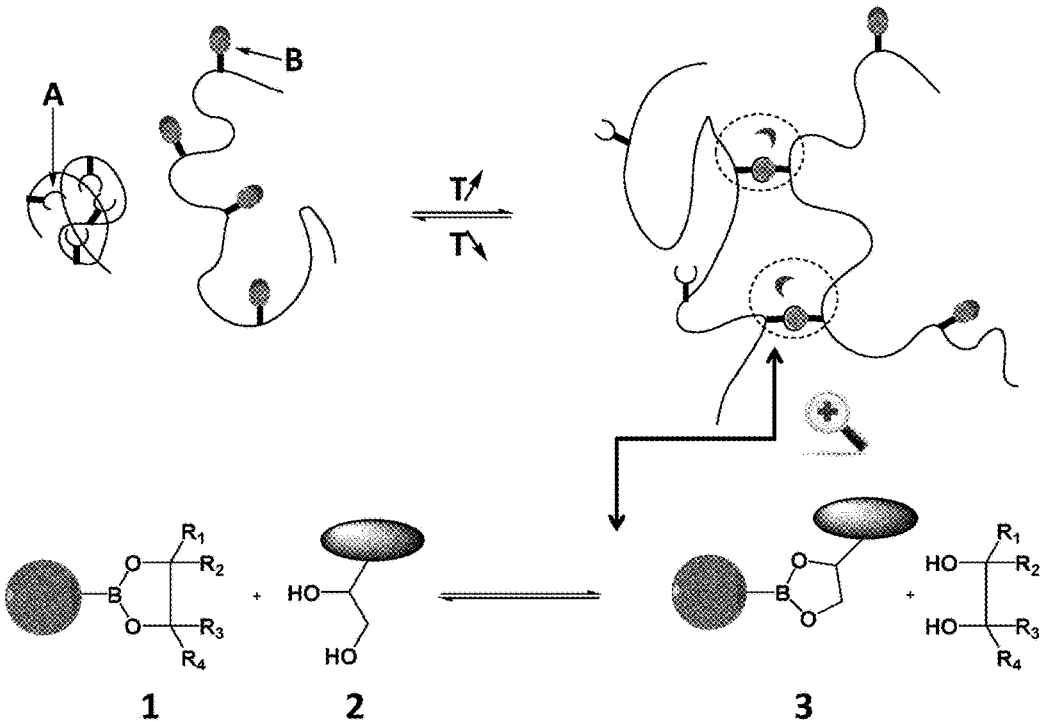
FIG. 4 shows diagrammatically the behaviour of the composition of the invention as a function of temperature. A statistical copolymer (2) having diol functions (function A) can associate in a thermoreversible manner with a statistical copolymer (1) having boronic ester functions (function B) via a transesterification reaction. The organic group of the boronic ester functions (function B) which are exchanged during the transesterification reaction is a diol symbolized by a black crescent. A chemical bond (3) of boronic ester type forms with the release of a diol compound.

By "associative", is meant that covalent chemical bonds of boronic ester type are established between the polydiol statistical copolymers A1, in particular those resulting from the copolymerization of at least one monomer of formula (I) with at least one monomer of formula (II-A) or of at least one monomer of formula (I) with at least one monomer of formula (II-A1) and at least one monomer of formula (II-A2), and the compounds A2 comprising at least two boronic ester functions. FIG. 4 shows associative polymers. Depending on the functionality of the polydiols A1, in particular those resulting from the copolymerization of at least one monomer of formula (I) with at least one monomer of formula (II-A) or of at least one monomer of formula (I) with at least one monomer of formula (II-A1) and at least one monomer of formula (II-A2), and the compounds A2 and depending on the composition of the mixtures, the formation of the covalent bonds between the polydiols A1 and the compounds A2 may or may not lead to the formation of a three-dimensional polymeric network.

By "chemical bond", is meant a covalent chemical bond of boronic ester type.

By "exchangeable", is meant that the compounds are capable of exchanging chemical bonds between each other without the total number of chemical functions being modified. The boronic ester bonds of the compounds A2 as well as the boronic ester bonds formed by association of the polydiol statistical copolymers A1 , in particular those resulting from the copolymerization of at least one monomer of formula (I) with at least one monomer of formula (II-A) or of at least one monomer of formula (I) with at least one monomer of formula (II-A1) and at least one monomer of formula (II-A2), and the compounds A2 can be exchanged with diol functions present in the composition in order to form new boronic esters and new diol functions without the total number of boronic ester functions and diol functions being affected. The chemical exchange reaction (transesterification) is shown in the following reaction 9:

Diagram 9

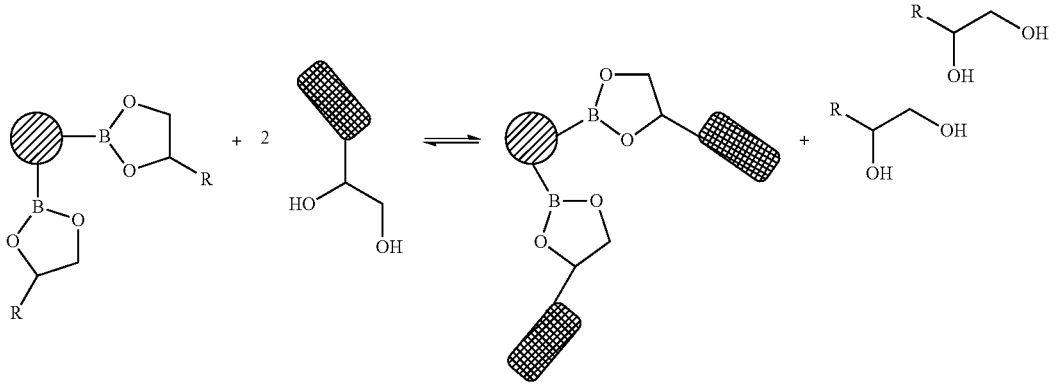

with:

R a chemical group of compound A2, the hatched circle symbolizes the remainder of the chemical structure of the compound A2, the cross-hatched rectangle symbolizes the remainder of the chemical structure of the polydiol statistical copolymer A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2).

Figure 9:
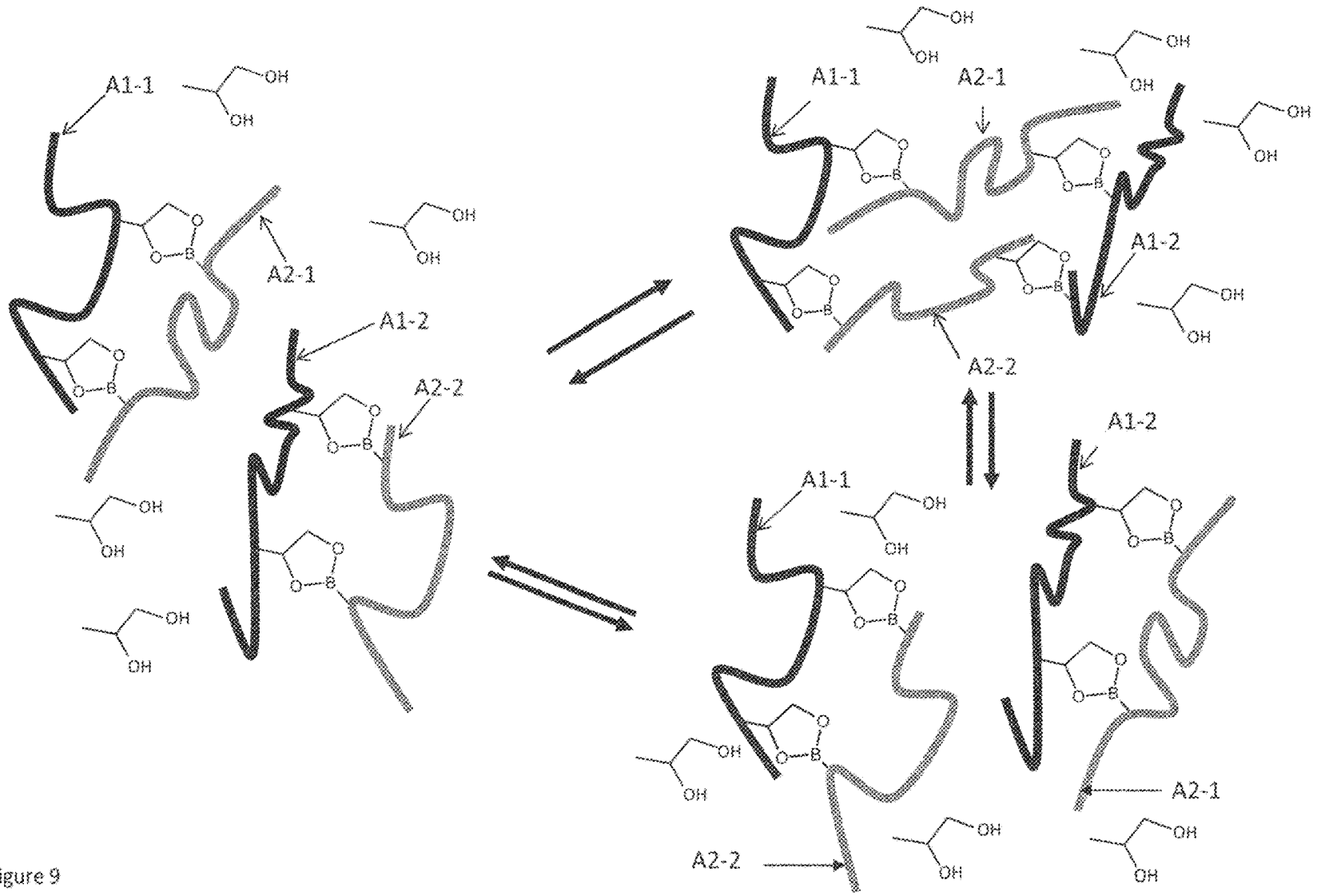
FIG. 9 shows diagrammatically the exchange reactions of boronic ester bonds between two polydiol statistical polymers (A1-1 and A1-2) and two boronic ester statistical polymers (A2-1 and A2-2) in the presence of diols.

The boronic ester bonds of the compounds A2 as well as the boronic ester bonds formed by association of the polydiol statistical copolymers A1, in particular those resulting from the copolymerization of at least one monomer of formula (I) with at least one monomer of formula (II-A) or of at least one monomer of formula (I) with at least one monomer of formula (II-A1) and at least one monomer of formula (II-A2), and the compounds A2 can also be exchanged in order to form new boronic esters without the total number of boronic ester functions being affected. This other process of exchange of chemical bonds is carried out by metathesis reaction, via successive exchanges of boronic ester functions in the presence of diols; this process is shown in FIG. 9. The polydiol statistical copolymer A1-1, which was associated with the polymer A2-1, has exchanged a boronic ester bond with the boronic ester statistical copolymer A2-2. The polydiol statistical copolymer A1-2, which was associated with the polymer A2-2, has exchanged a boronic ester bond with the boronic ester statistical copolymer A2-1; the total number of boronic ester bonds in the composition being unchanged and equal to 4. The copolymer A1-1 is then associated both with the polymer A2-1 and with the copolymer A2-2. The copolymer A1-2 is then associated both with the copolymer A2-1 and with the copolymer A2-2

Another process of exchange of chemical bonds is shown in FIG. 9, in which it can be observed that the polydiol statistical copolymer A1-1, which was associated with the polymer A2-1, has exchanged two boronic ester bonds with the boronic ester statistical copolymer A2-2. The polydiol statistical copolymer A1-2, which was in association with the polymer A2-2, has exchanged two boronic ester bonds with the boronic ester statistical copolymer A2-1; the total number of boronic ester bonds in the composition being unchanged and equal to 4. The copolymer A1-1 is then associated with the polymer A2-2. The copolymer A1-2 is then associated with the polymer A2-1. The copolymer A2-1 has been exchanged with the polymer A2-2.

Figure 3:
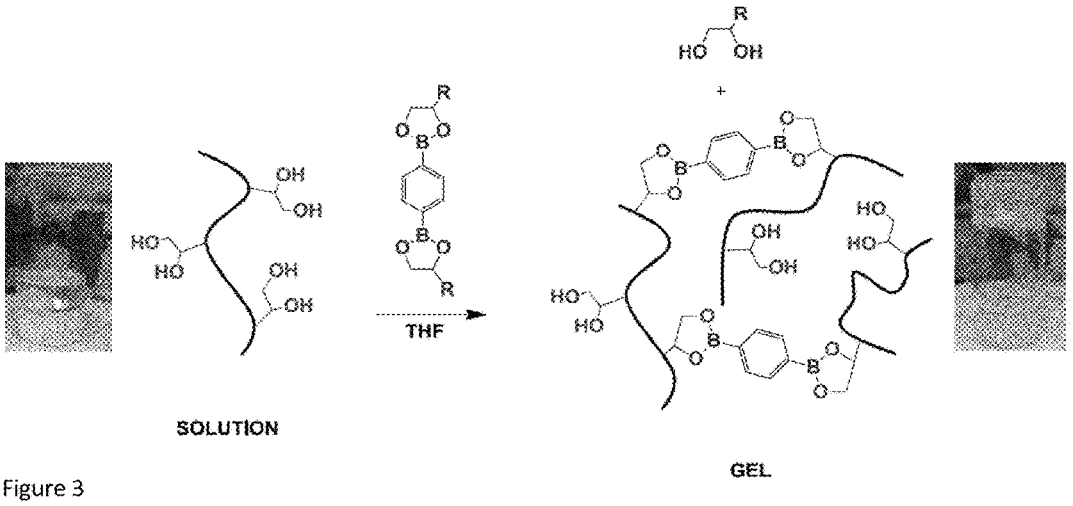
FIG. 3 illustrates and shows diagrammatically a solubility test of the composition according to the invention in tetrahydrofuran (THF).

By "cross-linked", is meant a copolymer in the form of a network obtained by the establishment of bridges between the macromolecular chains of the copolymer. These chains, linked together, are mainly distributed in the three spatial dimensions. A cross-linked copolymer forms a three-dimensional network. In practice, the formation of a copolymer network is ensured by a solubility test. It is possible to verify that a network of copolymers has been formed by placing the copolymer network in a known solvent in order to dissolve the non-crosslinked copolymers of the same chemical composition. If the copolymer swells instead of dissolving, a person skilled in the art knows that a network has been formed. FIG. 3 illustrates this solubility test.

By "cross-linkable" is meant a copolymer capable of being cross-linked.

By "cross-linked in a reversible manner" is meant a cross-linked copolymer the bridges of which are formed by a reversible chemical reaction. The reversible chemical reaction can be shifted in one direction or another, leading to a change in structure of the polymer network. The copolymer can pass from an initial non cross-linked state to a cross-linked state (three-dimensional network of copolymers) and from a cross-linked state to an initial non cross-linked state. Within the context of the present invention, the bridges which form between the copolymer chains are labile. These bridges can form or be exchanged thanks to a chemical reaction which is reversible. Within the context of the present invention, the reversible chemical reaction is a transesterification reaction between diol functions of a statistical copolymer (copolymer A1) in particular that resulting from the copolymerization of at least one monomer of formula (I) with at least one monomer of formula (II-A) or of at least one monomer of formula (I) with at least one monomer of formula (II-A1) and at least one monomer of formula (II-A2)) and the boronic ester functions of compound A2. The bridges formed are bonds of the boronic ester type. These boronic ester bonds are covalent and labile due to the reversibility of the transesterification reaction.

By "cross-linked in a thermoreversible manner", is meant a copolymer which is cross-linked due to a reversible reaction the shift of which in one direction or in the other direction is controlled by the temperature. The thermoreversible cross-linking mechanism of the composition of the invention is shown diagrammatically in FIG. 4. Unexpectedly, the Applicant observed that at low temperature, the polydiol copolymer A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2) (symbolized by the copolymer bearing the functions A in FIG. 4) is not, or only slightly, cross-linked by the boronic ester compounds A2 (symbolized by the compound bearing the functions B in FIG. 4). When the temperature increases, the diol functions of the copolymer react with the boronic ester functions of the compound A2 by a transesterification reaction. The polydiol statistical copolymers A1, in particular those resulting from the copolymerization of at least one monomer of formula (I) with at least one monomer of formula (II-A) or of at least one monomer of formula (I) with at least one monomer of formula (II-A1) and at least one monomer of formula (II-A2), and the compounds A2 comprising at least two boronic ester functions then link together and can exchange. Depending on the functionality of the polydiols A1, in particular those resulting from the copolymerization of at least one monomer of formula (I) with at least one monomer of formula (II-A) or of at least one monomer of formula (I) with at least one monomer of formula (II-A1) and at least one monomer of formula (II-A2), and of the compounds A2 and depending on the composition of the mixtures, a gel may form in the medium, in particular when the medium is apolar. When the temperature reduces again, the boronic ester bonds between the polydiol statistical copolymers A1, in particular those resulting from the copolymerization of at least one monomer of formula (I) with at least one monomer of formula (II-A) or of at least one monomer of formula (I) with at least one monomer of formula (II-A1) and at least one monomer of formula (II-A2), and the compounds A2 break, and if applicable, the composition loses its gel character.

The quantity of boronic ester bonds (or boronic ester links) that can be established between the polydiol statistical copolymers A1 and the compounds A2 is adjusted by a person skilled in the art by means of an appropriate selection of the polydiol statistical copolymer A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2), and of compound A2 and of the composition of the mixture. Moreover, a person skilled in the art knows how to select the structure of the compound A2 as a function of the structure of the statistical copolymer A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2). Preferably, when in the statistical copolymer A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2), comprising at least one monomer M1 in which y=1, then compound A2 of general formula (III) or the copolymer A2 comprising at least one monomer M3 of formula (IV) is preferably selected with $w_1=1$, $w_2=1$ and t=1, respectively.

Advantageously, the content of statistical copolymer A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2) in the composition ranges from 0.25% to 20% by weight with respect to the total weight of the final composition, preferably from 1 to 10% by weight with respect to the total weight of the final composition. Advantageously, the content of compound A2 in the composition ranges from 0.25% to 20% by weight with respect to the total weight of the final composition, preferably from 0.5 to 10% by weight with respect to the total weight of the final composition.

Preferentially, the mass ratio between the polydiol statistical compound A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2), and the compound A2 (ratio A1 /A2) in the composition ranges from 0.001 to 100, preferably from 0.05 to 20, yet more preferably from 0.1 to 10, most preferably from 0.2 to 5. In an embodiment of the invention, the sum of the masses of the statistical copolymer A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2), and of the compound A2 ranges from 0.5 to 20% with respect to the total mass of the lubricating composition and the mass of lubricating oil ranges from 80% to 99.5% with respect to the total mass of the lubricating composition. In an embodiment, the composition of the invention can comprise moreover a functional additive selected from the group formed by the detergents, anti-wear additives, extreme-pressure additives, antioxidants, polymers improving the viscosity index, pour point improvers, anti-foaming agents, thickeners, corrosion inhibitors, dispersants, friction modifiers and mixtures thereof.

Functional Additives

The functional additive(s) which are added to the composition of the invention are selected depending on the final use of the lubricating composition. These additives can be introduced in two different ways:

- either each additive is added separately and sequentially into the composition,
- or the mixture of additives is added simultaneously into the composition, the additives are in this case generally available in the form of a package, called package of additives.

The functional additive or the mixtures of functional additives, when they are present, represent from 0.1 to 10% by weight with respect to the total weight of the composition.

The Detergents:

These detergent additives reduce the formation of deposits on the surface of the metal parts by dissolving the by-products of oxidation and combustion. The detergents that can be used in the lubricant composition according to the invention are well known to a person skilled in the art. The detergents commonly used in the formulation of lubricant compositions are typically anionic compounds comprising a long lipophilic hydrocarbon-containing chain and a hydrophilic head. The associated cation is typically a metal cation of an alkali or alkaline-earth metal. The detergents are preferentially chosen from the alkali or alkaline-earth metal salts of carboxylic acids, sulphonates, salicylates, naphthenates, as well as the salts of phenates. The alkali or alkaline-earth metals are preferentially calcium, magnesium, sodium or barium. These metal salts can contain the metal in an approximately stoichiometric quantity or in excess (in a quantity greater than the stoichiometric quantity). In the latter case, these detergents are referred to as overbased detergents. The excess metal providing the detergent with its overbased character is present in the form of metal salts which are insoluble in oil, for example carbonate, hydroxide, oxalate, acetate, glutamate, preferentially carbonate.

The Anti-wear Additives and Extreme-pressure Additives:

These additives protect the friction surfaces by the formation of a protective film adsorbed on these surfaces. A great variety of anti-wear and extreme-pressure additives exists. By way of examples, the following can be mentioned: phosphorus- and sulphur-containing additives such as the metallic alkylthiophosphates, in particular zinc alkylthiophosphates, and more specifically zinc dialkyldithiophosphates or ZnDTP, amine phosphates, polysulphides, in particular sulphur-containing olefins and metallic dithiocarbamates.

The Antioxidants:

These additives slow down the degradation of the composition. The degradation of the composition may become apparent through the formation of deposits, the presence of sludges, or an increase in the viscosity of the composition. The antioxidant additives act as radical inhibitors or hydroperoxide destroyers. Phenolic or amine type antioxidants are among those is current use.

The Corrosion Inhibitors:

These additives cover the surface with a film which prevents oxygen access to the surface of the metal. They can sometimes neutralize acids or certain chemical products in order to avoid corrosion of the metal. By way of illustration, the following can be mentioned for example: dimercaptothiadiazole (DMTD), benzotriazoles, phosphites (capture of the free sulphur).

The Polymers Improving the Viscosity Index:

These additives make it possible to guarantee good resistance to cold and a minimum viscosity at high temperature of the composition. By way of illustration, the following can be mentioned for example: polymeric esters, olefin copolymers (OCP), homopolymers or copolymers of styrene, butadiene or isoprene and polymethacrylates (PMA).

The Pour Point Improvers:

These additives improve the low-temperature behaviour of the compositions, by slowing down the formation of paraffin crystals. They are for example alkyl polymethacrylates, polyacrylates, polyarylamides, polyalkylphenols, polyalkylnaphthalenes and alkylated polystyrenes.

The Anti-foaming Agents:

These additives have the effect of countering the effect of the detergents. By way of illustration, the following can be mentioned: polymethylsiloxanes and polyacrylates.

The Thickeners:

The thickeners are additives used above all for industrial lubrication and make it possible to formulate lubricants with a higher viscosity than engine lubricating compositions. By way of illustration, the following can be mentioned: polysiobutenes having a molar mass by weight from 10,000 to 100,000 g/mol.

The Dispersants:

These additives ensure the maintenance in suspension and the removal of the insoluble solid contaminants constituted by the by-products of oxidation which form during use of the composition. By way of illustration, the following can be mentioned: succinimides, PIB (polyisobutene) succinimides and Mannich bases.

The Friction Modifiers

These additives improve the coefficient of friction of the composition. By way of illustration, the following can be mentioned: molybdenum dithiocarbamate, the amines having at least one hydrocarbon-containing chain of at least 16 carbon atoms, the esters of fatty acids and polyols such as the esters of fatty acids and glycerol, in particular glycerol monooleate.

Process for the Preparation of the Novel Compositions of the Invention

The novel compositions of the invention are prepared by means well known to a person skilled in the art. For example, it is sufficient for a person skilled in the art in particular to:

- sample a desired quantity of a solution comprising the polydiol statistical copolymer A1 as defined above, in particular that resulting from the copolymerization of at least one monomer of formula (I) with at least one monomer of formula (II-A) or of at least one monomer of formula (I) with at least one monomer of formula (II-A1) and at least one monomer of formula (II-A2);
- sample a desired quantity of a solution comprising compound A2 as defined above;
- mix the two solutions sampled in a lubricating base oil in order to obtain the composition of the invention.

A person skilled in the art also knows how to adjust the different parameters of the composition of the invention in order to obtain a cross-linkable composition. For example, a person skilled in the art knows how to adjust in particular:

- the molar percentage of the monomer M1 bearing diol functions in the polydiol statistical copolymer A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2);
- the molar percentage of monomer M3 bearing the boronic ester functions in the boronic ester statistical copolymer A2,
- the average length of the side chains of the polydiol statistical copolymer A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2);
- the average length of the side chains of the boronic ester statistical copolymer A2,
- the length of the monomer M3 of the boronic ester statistical copolymer A2,
- the length of boronic diester compound A2,
- the average degree of polymerization of the polydiol statistical copolymers A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2), and the boronic ester statistical copolymers A2, the percentage by weight of the polydiol statistical copolymers A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2), the percentage by weight of the diboronic ester compound A2, the percentage by weight of the boronic ester statistical copolymer A2, etc.

Use of the Novel Compositions of the Invention

Another subject of the present invention is the use of the composition as defined above for lubricating a mechanical part. The compositions of the invention can be used to lubricate the surfaces of the parts that can conventionally be found in an engine, such as the pistons, rings, liners system.

Thus another subject of the present invention is a composition for lubricating at least one engine comprising a composition resulting from the mixing of:

97% to 99.9% by weight of a lubricating oil, and 0.1% to 3% by weight of at least one statistical copolymer A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2), and at least one compound A2 comprising at least two boronic ester functions such as defined previously; the composition having a kinematic viscosity at 100° C. measured according to the standard ASTM D445 ranging from 3.8 to 26.1 cSt; the percentages being expressed with respect to the total weight of the lubricating composition.

In a composition for lubricating at least one engine, at least one statistical copolymer A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2), and at least one compound A2 comprising at least two boronic ester functions such as defined previously can associate and exchange in a thermoreversible manner; but they do not form three-dimensional networks. They are not cross-linked. In an embodiment, the composition for lubricating at least one engine moreover comprises at least one functional additive selected from the group formed by the detergents, anti-wear additives, extreme-pressure additives, additional antioxidants, corrosion inhibitors, polymers improving the viscosity index, pour point improvers, anti-foaming agents, thickeners, dispersants, friction modifiers and mixtures thereof.

In an embodiment of the invention, the composition for lubricating at least one engine essentially consists of a composition resulting from the mixing of:

97% to 99.9% by weight of a lubricating oil, and 0.1% to 3% by weight of at least one statistical copolymer A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2), and at least one compound A2 comprising at least two boronic ester functions as defined previously;

the composition having a kinematic viscosity at 100° C. measured according to the standard ASTM D445 ranging from 3.8 to 26.1 cSt; the percentages being expressed with respect to the total weight of the lubricating composition.

In an embodiment of the invention, the composition for lubricating at least one engine essentially consists of a composition resulting from the mixing of:

82% to 99.8% by weight of a lubricating oil, and 0.1% to 3% by weight of at least one statistical copolymer A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2), and at least one compound A2 comprising at least two boronic ester functions such as defined previously;

0.1% to 15% by weight of at least one functional additive selected from the group formed by the detergents, anti-wear additives, extreme-pressure additives, additional antioxidants, corrosion inhibitors, polymers improving the viscosity index, pour point improvers, anti-foaming agents, thickeners, dispersants, friction modifiers and mixtures thereof;

the composition having a kinematic viscosity at 100° C. measured according to the standard ASTM D445 ranging from 3.8 to 26.1 cSt; the percentages being expressed with respect to the total weight of the lubricating composition.

The definitions and preferences relating to the lubricating oils, statistical copolymers A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2), and compounds A2 also apply to the compositions for lubricating at least one engine. Another subject of the present invention is a composition for lubricating at least one transmission, such as the manual or automatic gearboxes. In a composition for lubricating at least one transmission, at least one statistical copolymer A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2), and at least one compound A2 comprising at least two boronic ester functions such as defined previously can associate and exchange in a thermoreversible manner; but they do not form three-dimensional networks. They are not cross-linked.

Thus another subject of the present invention is a composition for lubricating at least one transmission comprising a composition resulting from the mixing of:

85% to 99.5% by weight of a lubricating oil, and 0.5% to 15% by weight of at least one statistical copolymer A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2), and at least one compound A2 comprising at least two boronic ester functions as defined previously;

the composition having a kinematic viscosity at 100° C. measured according to the standard ASTM D445 ranging from 4.1 to 41 cSt; the percentages being expressed with respect to the total weight of the lubricating composition.

In an embodiment, the composition for lubricating at least one transmission comprises moreover at least one functional additive selected from the group formed by the detergents, anti-wear additives, extreme-pressure additives, additional antioxidants, corrosion inhibitors, polymers improving the viscosity index, pour point improvers, anti-foaming agents, thickeners, dispersants, friction modifiers and mixtures thereof.

In an embodiment of the invention, the composition for lubricating at least one transmission essentially consists of a composition resulting from the mixing of:

95% to 99.5% by weight of a lubricating oil, and 0.5% to 15% by weight of at least one statistical copolymer A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2), and at least one compound A2 comprising at least two boronic ester functions as defined previously;

the composition having a kinematic viscosity at 100° C. measured according to the standard ASTM D445 ranging from 4.1 to 41 cSt.

In an embodiment of the invention, the composition for lubricating at least one transmission essentially consists of a composition resulting from the mixing of:

70% to 99.4% by weight of a lubricating oil, and 0.5% to 15% by weight of at least one statistical copolymer A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2), and at least one compound A2 comprising at least two boronic ester functions such as defined previously;

0.1% to 15% by weight of at least one functional additive selected from the group formed by the detergents, anti-wear additives, extreme-pressure additives, additional antioxidants, corrosion inhibitors, polymers improving the viscosity index, pour point improvers, anti-foaming agents, thickeners, dispersants, friction modifiers and mixtures thereof;

the composition having a kinematic viscosity at 100° C. measured according to the standard ASTM D445 ranging from 4.1 to 41 cSt; the percentages being expressed with respect to the total weight of the lubricating composition.

The definitions and preferences relating to the lubricating oils, statistical copolymers A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2), and compounds A2 also apply to the compositions for lubricating at least one transmission. The compositions of the invention can be used for the engines or transmissions of light vehicles, lorries but also ships. Another subject of the present invention is a process for lubricating at least one mechanical part, in particular at least one engine or at least one transmission, said process comprising a step in which said mechanical part is brought into contact with at least one composition as defined above.

The definitions and preferences relating to the lubricating oils, statistical copolymers A1, in particular that resulting from the copolymerization of at least one monomer of formula (I) with at least one monomer of formula (II-A) or of at least one monomer of formula (I) with at least one monomer of formula (II-A1) and at least one monomer of formula (II-A2), and compounds A2 also apply to the process for lubricating at least one mechanical part. Another subject of the present invention relates to a stock composition resulting from the mixing of at least at least one statistical copolymer A1 as defined-above, in particular that resulting from the copolymerization of at least one monomer of formula (I) with at least one monomer of formula (II-A) or of at least one monomer of formula (I) with at least one monomer of formula (II-A1) and at least one monomer of formula (II-A2), at least one compound A2 comprising at least two boronic ester functions, at least one functional additive selected from the group formed by the detergents, anti-wear additives, extreme-pressure additives, additional antioxidants, polymers improving the viscosity index, pour point improvers, anti-foaming agents, corrosion inhibitors, thickeners, dispersants, friction modifiers and mixtures thereof.

By "stock composition" is meant, a composition from which a person skilled in the art can make working solutions by sampling a certain quantity of stock solution completed by making up with a necessary quantity of diluent (solvent or other) in order to obtain a desired concentration. A working composition is therefore obtained by dilution of a stock composition. In an embodiment the lubricating compositions of the invention can be obtained by diluting in a lubricating oil, in particular a base oil of Group I, Group II, Group III, Group IV, Group V of the API classification or a mixture thereof, the stock composition as defined above.

EXAMPLES

The following examples illustrate the invention without limiting it.

1 Synthesis of Polymethacrylate Statistical Copolymers A1 of the Invention Bearing a Diol Function 1.1: Starting from a Monomer Bearing a Diol Function Protected in Ketal Form In an embodiment, the statistical copolymer A1 of the invention is obtained according to the following reaction diagram 10:

Diagram 10

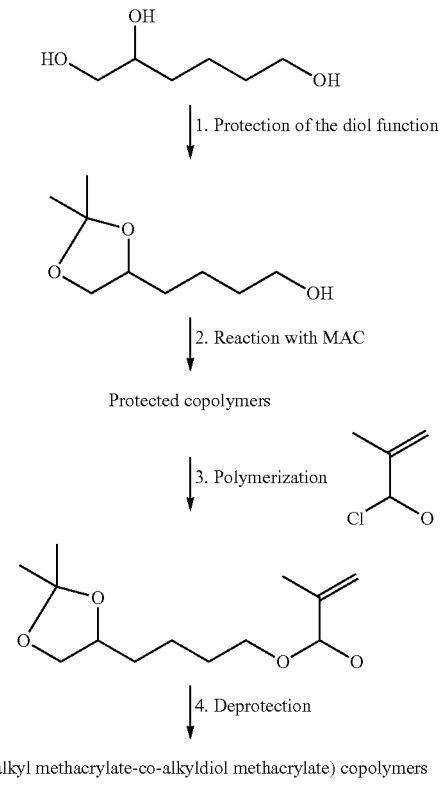

1.1.1 Synthesis of the Monomer M1 Bearing a Diol Function Protected in Ketal Form The synthesis of a methacrylate monomer bearing a diol function protected in ketal form is carried out in two steps (steps 1 and 2 of reaction diagram 10) according to the protocol below:

1st Step:

42.1 g (314 mmol) of 1,2,6-hexane triol (1,2,6-HexTri) is introduced into a 1-L flask. 5.88 g of molecular sieve (4° A) is added followed by 570 mL of acetone. 5.01 g (26.3 mmol) of para-toluene-sulphonic acid (pTSA) is then slowly added. The reaction medium is left under stirring for 24 hours at ambient temperature. 4.48 g (53.3 mmol) of $NaHCO_3$ is then added. The reaction medium is left under stirring for 3 hours at ambient temperature before being filtered. The filtrate is then concentrated under vacuum by means of a rotary evaporator until a suspension of white crystals is obtained. 500 mL of water is then added to this suspension. The solution thus obtained is extracted with 4×300 mL of dichloromethane. The organic phases are combined and dried over $MgSO_4$. The solvent is then completely evaporated off under vacuum at 25° C. by means of a rotary evaporator.

$2^{nd}$ Step:

The product thus obtained is then introduced into a 1-L flask surmounted by a dropping funnel. The glassware used having been previously dried overnight in an oven thermostatically controlled at 100° C. 500 mL of anhydrous dichloromethane is then introduced into the flask followed by 36.8 g (364 mmol) of triethylamine. A solution of 39.0 g (373 mmol) of methacryloyl chloride (MAC) in 50 mL of anhydrous dichloromethane is introduced into the dropping funnel. The flask is then placed in an ice bath in order to lower the temperature of the reaction medium to around 0° C. The methacryloyl chloride solution is then added dropwise under vigorous stirring. Once the addition of the methacryloyl chloride is completed, the reaction medium is left under stirring at 0° C. for 1 hour, then at ambient temperature for 23 hours. The reaction medium is then transferred into a 3-L Erlenmeyer flask and 1 L of dichloromethane is added. The organic phase is then successively washed with 4×300 mL of water, 6×300 mL of a 0.5M aqueous solution of hydrochloric acid, 6×300 mL of a saturated aqueous solution of $NaHCO_3$ and again 4×300 mL of water. The organic phase is dried over $MgSO_4$, filtered then concentrated under vacuum using a rotary evaporator in order to produce 64.9 g (yield of 85.3%) of protected diol monomer in the form of a light yellow liquid the characteristics of which are as follows:

$^1$H NMR (400 MHz, CDCl3) δ: 6.02 (singlet, 1H), 5.47 (singlet, 1H), 4.08 (triplet, J=6.8 Hz, 2H), 4.05-3.98 (multiplet, 1H), 3.96 (doublet of doublets, J=6 Hz and J=7.6 Hz, 1H), 3.43 (doublet of doublets, J=7.2 Hz and J=7.2 Hz, 1H), 1.86 (doublet of doublets, J=1.2 Hz and J=1.6 Hz, 3H), 1.69-1.33 (multiplet, 6H), 1.32 (singlet, 3H), 1.27 (singlet, 3H).

1.1.2 Synthesis of Methacrylate Copolymers According to the Invention Bearing Diol Functions The synthesis of the methacrylate copolymers bearing diol functions according to the invention is carried out in two steps (steps 3 and 4 of reaction diagram 10):

Copolymerization of two alkyl methacrylate monomers with a methacrylate monomer bearing a diol function protected in ketal form;

Deprotection of the copolymer.

More precisely, the synthesis of the copolymer is carried out according to the following protocol:

10.5 g (31.0 mmol) of stearyl methacrylate (StMA), 4.76 g (18.7 mmol) of lauryl methacrylate (LMA), 3.07 g (12.7 mmol) of methacrylate bearing a diol function protected in ketal form obtained according to the protocol described in paragraph 1.1.1, 68.9 mg (0.253 mmol) of cumyl dithiobenzoate and 19.5 mL of anisole are introduced into a 100-mL Schlenk tube. The reaction medium is placed under stirring and 8.31 mg (0.0506 mmol) of azobisisobutyronitrile (AIBN) in solution in 85 μL of anisole is introduced into the Schlenk tube. The reaction medium is then degassed for 30 minutes by bubbling argon through it before being brought to 65° C. for a period of 16 hours. The Schlenk tube is placed in an ice bath in order to stop the polymerization, then the polymer is isolated by precipitation from methanol, followed by filtration and drying under vacuum at 30° C. overnight.

A copolymer is thus obtained, having a number-average molar weight ($M_n$) of 41,000 g/mol, a polydispersity index (PDI) of 1.22 and a number-average degree of polymerization ($DP_n$) of 167. These values are obtained respectively by steric exclusion chromatography using tetrahydrofuran as eluent and a polystyrene calibration and by monitoring the conversion to monomers during the copolymerization.

Deprotection of the copolymer is carried out according to the following protocol:

7.02 g of copolymer containing approximately 20% protected diol function obtained previously is introduced into a 500-mL Erlenmeyer flask. 180 mL of dioxane is added and the reaction medium is placed under stirring at 30° C. 3 mL of a 1M aqueous solution of hydrochloric acid, then 2.5 mL of an aqueous solution of hydrochloric acid, 35% by weight, are added dropwise. The reaction medium then becomes slightly opaque and 20 mL of THF is introduced in order to make the medium completely homogeneous and transparent. The reaction medium is then left under stirring at 40° C. for 48 hours. The copolymer is recovered by precipitation from methanol, filtration and drying under vacuum at 30° C. overnight.

A poly(alkyl methacrylate-co-alkyldiol methacrylate) copolymer is obtained, containing approximately 20 mol. % diol monomer units M1, and having an average pendant alkyl chain length of 13.8 carbon atoms.

1.2: Starting from a Monomer Bearing a Diol Function Protected in Boronic Ester Form In another embodiment, the statistical copolymer A1 of the invention is obtained according to the following reaction diagram 11:

Diagram 11

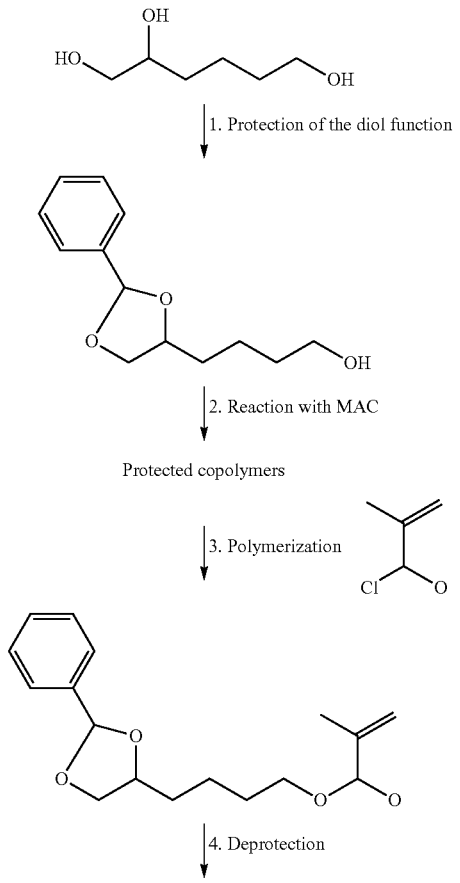

Poly(alkyl methacrylate-co-alkyldiol methacrylate) copolymers 1.2.1 Synthesis of the Monomer M1 Bearing a Diol Function Protected in Boronic Ester Form The synthesis of a methacrylate monomer bearing a diol function protected in ester form is carried out in two steps (steps 1 and 2 of Diagram 11) according to the following protocol:

$1^{st}$ Step:

6.01 g (49.3 mmol) of phenylboronic acid (PBA) and 300 mL of acetone are introduced into a 500-mL beaker, followed by 1.5 mL of water. The reaction medium is placed under stirring and 6.07 g (45.2 mmol) of 1,2,6-hexanetriol is added slowly. An excess of magnesium sulphate is added to the reaction medium in order to trap the water initially introduced as well as the water released by the condensation between the phenylboronic acid and the 1,2,6-hexanetriol. The reaction medium is left under stirring at ambient temperature for 30 minutes before being filtered then concentrated under vacuum by means of a rotary evaporator.

$2^{nd}$ Step:

The light yellow liquid thus obtained in the preceding step is then introduced into a 1-L flask surmounted by a dropping funnel. The glassware used having been pre-dried beforehand overnight in an oven thermostatically controlled at 100° C. 90 mL of anhydrous dichloromethane is then introduced into the flask followed by 6.92 g (68.4 mmol) of triethylamine. A solution of 5.82 g (55.7 mmol) of methacryloyl chloride (MAC) in 10 mL of anhydrous dichloromethane is introduced into the dropping funnel. The flask is then placed in an ice bath in order to lower the temperature of the reaction medium to around 0° C. The methacryloyl chloride solution is then added dropwise under vigorous stirring. Once the addition of the methacryloyl chloride is completed, the reaction medium is left under stirring at 0° C. for 1 hour, then at ambient temperature for 17 hours. The reaction medium is then transferred into a 500-mL Erlenmeyer flask and 300 mL of dichloromethane is added. The organic phase is then successively washed with 4×100 mL of water, 4×100 mL of a 0.1M aqueous solution of hydrochloric acid, 4×100 mL of a saturated aqueous solution of $NaHCO_3$ and again 4×100 mL of water. The organic phase is dried over $MgSO_4$, filtered then concentrated under vacuum using a rotary evaporator in order to produce 11.6 g (yield of 89%) of protected diol monomer in the form of a light yellow-coloured liquid the characteristics of which are as follows:

$^1$H NMR (400 MHz, CDCl3) δ: 7.81 (doublet of doublets, J=4 Hz and J=8 Hz, 2H), 7.48 (triplet of triplets, J=1.2 Hz and J=7.2 Hz, 1H), 7.38 (triplet of triplets, J=1.2 Hz and J=6.8 Hz, 1H), 6.10 (singlet, 1H), 5.55(singlet, 1H), 4.63-4.53 (multiplet, 1H), 4.44 (doublet of doublets, J=7.6 Hz and J=8.8 Hz, 1H), 4.18 (triplet, J=6.8 Hz, 2H), 3.95 (doublet of doublets, J=6.8 Hz and J=8.8 Hz, 1H), 1.94 (doublet of doublets, J=1.2 Hz and J=1.6 Hz, 3H), 1.81-1.47 (multiplet, 6H)

1.2.2 Synthesis of Methacrylate Copolymers According to the Invention Bearing Diol Functions The synthesis of the methacrylate copolymers bearing diol functions according to the invention is carried out in two steps (steps 3 and 4 of Diagram 11):

Copolymerization of two alkyl methacrylate monomers with a methacrylate monomer bearing a diol function protected in boronic ester form;

Deprotection of the copolymer.

The following procedures describe the synthesis of a poly (alkyl methacrylate-co-alkyldiol methacrylate) copolymer containing approximately 10 mol. % of diol monomer units, and having an average pendant alkyl chain length of 13.8 carbon atoms.

The synthesis of the polymer is carried out according to the following protocol:

13.5 g (40 mmol) of stearyl methacrylate (StMA), 12 g (47.2 mmol) of lauryl methacrylate (LMA), 3.12 g (10.8 mmol) of methacrylate bearing a diol function protected in boronic ester form, 92.1 mg (0.416 mmol) of cumyl dithiobenzoate and 34 mL of anisole are introduced into a 100-mL Schlenk tube. The reaction medium is placed under stirring and 13.7 mg (0.0833 mmol) of azobisisobutyronitrile (AIBN) in solution in 135 μL of anisole is introduced into the Schlenk tube. The reaction medium is then degassed for 30 minutes by bubbling argon through it before being brought to 65° C. for a period of 24 hours. The Schlenk tube is placed in an ice bath in order to stop the polymerization and 30 mL of tetrahydrofuran (THF) is then added to the reaction medium. The polymer is isolated by precipitation from cold methanol, followed by filtration and drying under vacuum at 30° C. overnight.

A copolymer is thus obtained, having a number-average molar weight ($M_n$) of 70,400 g/mol, a polydispersity index (PDI) of 3.11 and a number-average degree of polymerization ($DP_n$) of 228. These values are obtained respectively by steric exclusion chromatography using tetrahydrofuran as eluent and a polystyrene calibration and by monitoring the conversion to monomers during the copolymerization.

Deprotection of the copolymer is carried out according to the following protocol:

19 g of copolymer obtained in the preceding step and containing approximately 10% protected diol function is introduced into a 1-L Erlenmeyer flask. 250 mL of dichloromethane and 30 mL of an aqueous solution of hydrochloric acid are added. The reaction medium is stirred at ambient temperature for 24 hours before being poured dropwise into 1 L of aqueous solution of sodium hydroxide (pH=10) then stirred at ambient temperature for another 24 hours. Throughout this period of stirring, the reaction medium is composed of two phases. The organic phase is recovered using a separating funnel and the polymer is precipitated from cold methanol. The polymer thus obtained is redissolved in 100 ml of dichloromethane in order to be precipitated from cold methanol again. The polymer is recovered and dried under vacuum at 30° C. overnight.

A poly(alkyl methacrylate-co-alkyldiol methacrylate) copolymer is obtained containing approximately 10 mol. % diol monomer units, and having an average pendant alkyl chain length of 13.8 carbon atoms.

2. Synthesis of the Compounds A2 of the Invention 2.1: Synthesis of a Boronic Diester as Cross-linking Agent The synthesis of a compound A2 according to the invention is carried out according to the following protocol and according to reaction diagram 12:

Diagram 12

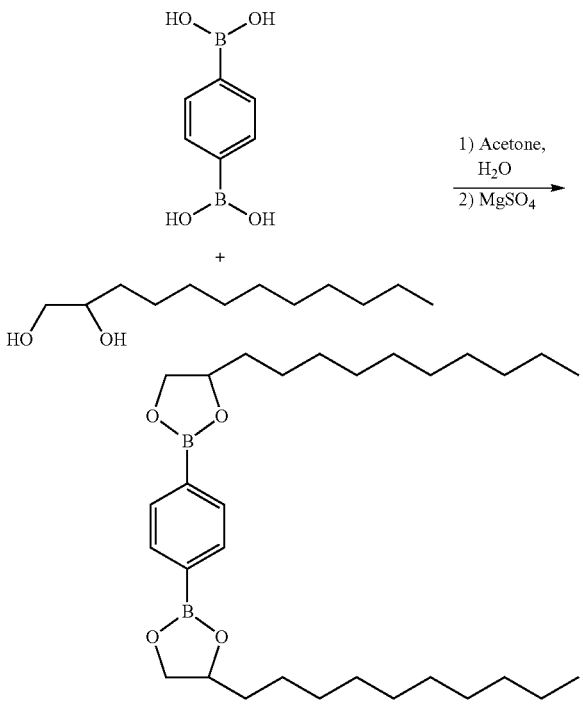

1,4 Benzenediboronic acid (1,4-BDBA) (1.5 g; 9.05 mmol) is introduced into a 500-mL beaker, followed by 300 mL of acetone. The reaction medium is placed under stirring and 0.300 g (16.7 mmol) of water is introduced dropwise. The reaction medium then becomes transparent and homogeneous and 1,2-dodecanediol (4.02 g; 19.9 mmol) is slowly added. After the latter is completely dissolved, an excess of magnesium sulphate is added in order to trap the water introduced initially as well as the water released by the condensation between the 1,4-BDBA and the 1,2-dodecanediol. After 15 minutes under stirring, the reaction medium is filtered. The solvent is then removed from the filtrate by means of a rotary evaporator, in order to produce 4.41 g of boronic diester and 1,2-dodecanediol (yield of 98%) in the form of a white solid.

The characteristics are as follows:

$^1$H NMR (400 MHz, CDCl3) Boronic diester: δ: 7.82 (singlet, 2H), 4.63-4.51 (multiplet, 2H), 4.42 (doublet of doublets, J=8 Hz and J=8.8 Hz, 2H), 3.95 (doublet of doublets, J=7.2 Hz and J=8.8 Hz, 2H), 1.81-1.31 (multiplet, 36H), 0.88 (triplet, J=7.2 Hz, 6H); 1,2-dodecanediol: δ: 3.85-3.25 (multiplet, approximately 2.17H), 1.81-1.31 (multiplet, approximately 13.02H), 0.88 (triplet, J=7.2 Hz, approximately 2.17H)

2.2: Synthesis of the poly(alkyl methacylate-co-boronic ester monomer) Copolymer 2.2.1 Synthesis of the Boronic Ester Monomer The boronic ester monomer of the invention is synthesized according to the following reaction diagram 13:

Diagram 13

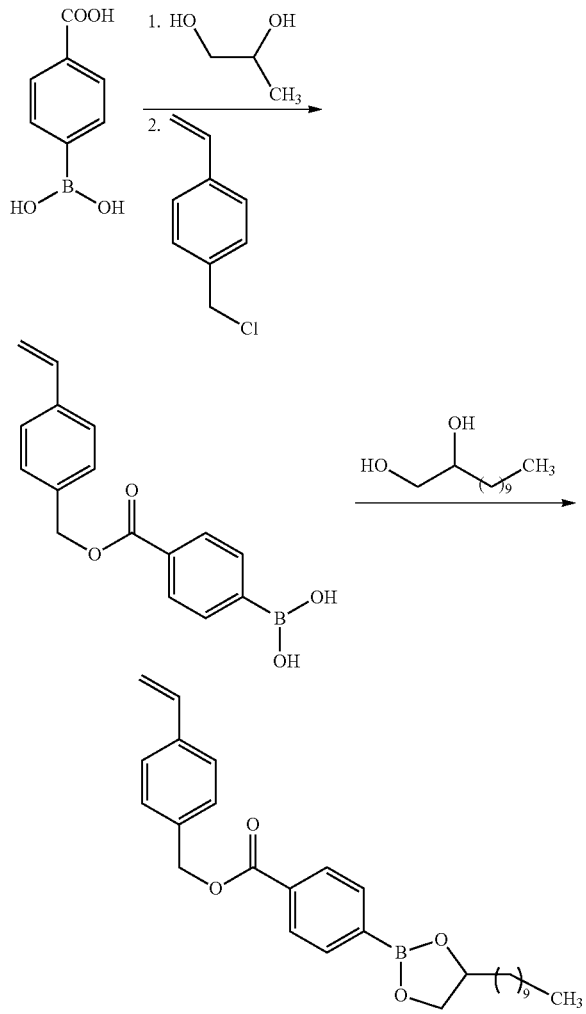

The monomer is obtained according to the two-step protocol:

The first step consists of synthesizing a boronic acid and the second step consists of obtaining a boronic ester monomer.

1st Step:

4-Carboxyphenylboronic acid (CPBA) (5.01 g; 30.2 mmol) is introduced into a 1-L beaker followed by 350 mL of acetone and the reaction medium is placed under stirring. 7.90 mL (439 mmol) of water is added dropwise until the 4-carboxyphenylboronic acid is completely dissolved. The reaction medium is then transparent and homogeneous. 1,2-Propanediol (2.78 g; 36.6 mmol) is then slowly added, followed by an excess of magnesium sulphate in order to trap the water initially introduced as well as the water released by the condensation between the CPBA and the 1,2-propanediol. The reaction medium is left under stirring for 1 hour at 25° C. before being filtered. The solvent is then removed from the filtrate by means of a rotary evaporator. The product thus obtained and 85 mL of DMSO are introduced into a 250-mL flask. The reaction medium is placed under stirring then after complete homogenization of the reaction medium, 8.33 g (60.3 mmol) of $K_2CO_3$ is added. 4-(Chloromethyl)styrene (3.34 g; 21.9 mmol) is then slowly introduced into the flask. The reaction medium is then left under stirring at 50° C. for 16 hours. The reaction medium is transferred into a 2-L Erlenmeyer flask, then 900 mL of water is added. The aqueous phase is extracted with 8×150 mL of ethyl acetate. The organic phases are combined, then extracted with 3×250 mL of water. The organic phase is dried over $MgSO_4$ and filtered. The solvent is removed from the filtrate by means of a rotary evaporator in order to produce the boronic acid monomer (5.70 g; yield of 92.2%) in the form of a white powder, the characteristics of which are as follows:

$^1$H NMR (400 MHz, CDCl3) δ: 7.98 (doublet, J=5.6 Hz, 4H), 7.49 (doublet, J=4 Hz, 4H), 6.77 (doublet of doublets, J=10.8 Hz and J=17.6 Hz, 1H), 5.83 (doublet of doublets, J=1.2 Hz and J=17.6 Hz, 1H), 5.36 (singlet, 2H), 5.24 (doublet of doublets, J=1.2 Hz and J=11.2 Hz, 1H).

$2^{nd}$ Step:

The boronic acid monomer (5.7 g; 20.2 mmol) obtained during the first step and 500 mL of acetone are introduced into a 1-L Erlenmeyer flask. The reaction medium is placed under stirring and 2.6 mL (144 mmol) of water is added dropwise until the boronic acid monomer is completely dissolved. The reaction medium is then transparent and homogeneous. A solution of 1,2-dodecanediol (5.32 g; 26.3 mmol) in 50 mL of acetone is slowly added to the reaction medium, followed by an excess of magnesium sulphate in order to trap the water initially introduced as well as the water released by the condensation between the boronic acid monomer and the 1,2-dodecanediol. After 3 hours under stirring at ambient temperature, the reaction medium is filtered. The solvent is then removed from the filtrate by means of a rotary evaporator in order to produce 10.2 g of a mixture of boronic ester monomer and 1,2-dodecanediol in the form of a light yellow solid, the characteristics of which are as follows:

$^1$H NMR (400 MHz, CDCl3): Boronic ester monomer: δ: 8.06 (doublet, J=8 Hz, 2H), 7.89 (doublet, J=8 Hz, 2H), 7.51 (doublet, J=4 Hz, 4H), 6.78 (doublet of doublets, J=8 Hz and J=16 Hz, 1H), 5.84 (doublet of doublets, J=1.2 Hz and J=17.6 Hz, 1H), 5.38 (singlet, 2H), 5.26 (doublet of doublets, J=1.2 Hz and J=11.2 Hz, 1H), 4.69-4.60 (multiplet, 1H), 4.49 (doublet of doublets, J=8 Hz and J=9.2 Hz, 1H), 3.99 (doublet of doublets, J=7.2 Hz and J=9.2 Hz, 1H), 1.78-1.34 (multiplet, 18H), 0.87 (triplet, J=6.4 Hz, 3H); 1,2-dodecanediol: δ: 3.61-3.30 (multiplet, approximately 1.62H), 1.78-1.34 (multiplet, approximately 9.72H), 0.87 (triplet, J=6.4 Hz, approximately 1.62H)

2.2.2 Synthesis of Compound A2, poly(alkyl methacrylate-co-boronic ester monomer) Statistical Copolymer The statistical copolymer A2 of the invention is obtained according to the following protocol:

2.09 g of a previously prepared mixture of boronic ester monomer and 1,2-dodecanediol (containing 3.78 mmol of boronic ester monomer), 98.3 mg (0.361 mmol) of cumyl dithiobenzoate, 22.1 g (86.9 mmol) of lauryl methacrylate (LMA) and 26.5 mL of anisole are introduced into a 100-mL Schlenk tube. The reaction medium is placed under stirring and 11.9 mg (0.0722 mmol) of azobisisobutyronitrile (AIBN) in solution in 120 μL of anisole is introduced into the Schlenk tube. The reaction medium is then degassed for 30 minutes by bubbling argon through it before being brought to 65° C. for a period of 16 hours. The Schlenk tube is placed in an ice bath in order to stop the polymerization, then the polymer is isolated by precipitation from anhydrous acetone, followed by filtration and drying under vacuum at 30° C. overnight.

A copolymer is thus obtained, having the following structure:

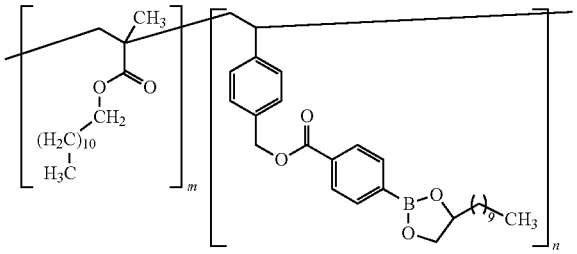

with m =0.96 and n=0.04.

The boronic ester copolymer obtained has a number-average molar weight ($M_n$) equal to 37,200 g/mol, a polydispersity index (PDI) equal to 1.24 and a number-average degree of polymerization ($DP_n$) equal to 166. These values are obtained respectively by steric exclusion chromatography using tetrahydrofuran as eluent and a polystyrene calibration and by monitoring the conversion to monomers during the copolymerization. NMR analysis of the proton of the final copolymer gives a composition of 4 mol. % boronic ester monomer and 96% lauryl methacrylate.

3. Rheological Studies 3.1 Equipment and Protocols for Measuring Viscosity

The rheological studies were carried out using a stress-controlled Couette MCR 501 rheometer from the company Anton Paar. The measurements were carried out on formulations of polymers in solution in a Group III base oil using a cylindrical geometry of reference DG 26.7. The viscosity was measured as a function of the shear rate for a temperature range varying from 10° C. to 110° C. For each temperature, the viscosity of the system was measured as a function of a shear rate of 0.01 to 1000 $s^{-1}$. The measurements of viscosity as a function of the shear rate at T=10° C., 20° C., 30° C., 50° C., 70° C., 90° C. and 110° C. were carried out (ranging from 10° C. to 110° C.) followed by new measurements at 10° C. and/or 20° C. in order to assess the reversibility of the systems. An average viscosity was then calculated for each temperature using the measurement points situated on the same plate.

The relative viscosity $$\left(\eta_{relative} = \frac{\eta_{solution}}{\eta_{base\ oil}}\right)$$

was also selected in order to represent the change in the viscosity of the system as a function of temperature, as this variable directly reflects the compensation for the loss of natural viscosity of the base oil of Group III of the polymer systems studied.

3.2: Compositions Based on Polydiol Statistical Copolymers A1 and Boronic Diester Compounds A2

Compositions Tested

Copolymers A1:

Four poly(alkyl methacrylate-co-alkyldiol methacrylate) statistical copolymers of the invention are tested. The copolymers are as follows:

Copolymer A1-1: This copolymer comprises 20 mol. % monomers having diol functions. The average side chain length is 13.8 carbon atoms. Its number-average molar weight is 49,600 g/mol. Its polydispersity index is 1.51. Its number-average degree of polymerization ($DP_n$) is 167. The number-average molar weight and the polydispersity index are measured by steric exclusion chromatography measurement using a polystyrene calibration.

Copolymer A1-2: This copolymer comprises 20 mol. % monomers having diol functions. The average side chain length is 10.8 carbon atoms. Its number-average molar weight is 59,700 g/mol. Its polydispersity index is 1.6. Its number-average degree of polymerization ($DP_n$) is 196. The number-average molar weight and the polydispersity index are measured by steric exclusion chromatography measurement using a polystyrene calibration.

Copolymer A1-3: This copolymer comprises 10 mol. % monomers having diol functions. The average side chain length is 13.8 carbon atoms. Its number-average molar weight is 47,800 g/mol. Its polydispersity index is 1.3. Its number-average degree of polymerization ($DP_n$) is 198. The number-average molar weight and the polydispersity index are measured by steric exclusion chromatography measurement using a polystyrene calibration.

Copolymer A1-4: This copolymer comprises 10 mol. % monomers having diol functions. The average side chain length is 13.8 carbon atoms. Its number-average molar weight is 97,100 g/mol. Its polydispersity index is 3.11. Its number-average degree of polymerization ($DP_n$) is 228. The number-average molar weight and the polydispersity index are measured by steric exclusion chromatography measurement using a polystyrene calibration.

The copolymers A1 -1, A1 -2, A1 -3 and A1 -4 are obtained according to one of the protocols described in paragraph 1.

Compound A2:

Compound A2-1 is the boronic diester obtained according to the protocol described in paragraph 2.1.

Lubricating Base Oil

The lubricating base oil used in the compositions to be tested is an oil of Group III of the API classification, marketed by SK under the name Yubase 4. It has the following characteristics:

its kinematic viscosity at 40° C. measured according to the standard ASTM D445 is 19.57 cSt;

its kinematic viscosity measured at 100° C. according to the standard ASTM D445 is 4.23 cSt;

its viscosity index measured according to the standard ASTM D2270 is 122;

its Noack volatility in percentage by weight, measured according to the standard DIN 51581 is 14.5;

Its flash point in degrees Celsius measured according to the standard ASTM D92 is 230° C.;

Its pour point in degrees Celsius measured according to the standard ASTM D97 is -15° C.

Composition A (not according to the invention) is used as reference.

It contains a solution with 4.2% by weight of a polymethacrylate polymer in a lubricating base oil of Group III of the API classification. The polymer has a number-average molar weight ($M_n$) equal to 106,000 g/mol, a polydispersity index (PDI) equal to 3.06, a number-average degree of polymerization of 466 and the average pendant chain length is 14 carbon atoms. This polymethacrylate is used as viscosity index improver additive. 4.95 g of a formulation having a concentration by weight of 42% of this polymethacrylate in a Group III base oil and 44.6 g of Group III base oil are introduced into a flask. The solution thus obtained is maintained under stirring at 90° C. until the polymethacrylate is completely dissolved. A solution with 4.2% by weight of this polymethacrylate is obtained.

Composition B-1 (not according to the invention) is obtained as follows:

4.14 g of polydiol copolymer A1-1 and 37.2 g of Group III base oil are introduced into a flask. The solution thus obtained is maintained under stirring at 90° C. until the polydiol is completely dissolved. A solution with 10% by weight polydiol copolymer A1-1 is obtained.

Composition C-1 (according to the invention) is obtained as follows:

8 g of the solution with 10% by weight polydiol copolymer A1-1 in the Group III base oil prepared previously is introduced into a flask. 55.8 mg of boronic diester A2-1 is added to this solution. The solution thus obtained is maintained under stirring at 90° C. until the boronic diester is completely dissolved. A solution with 10% by weight polydiol copolymer A1-1 and 20 mol. % boronic diester A2-1 with respect to the diol functions of the polydiol copolymer A1-1 is obtained.

Composition D-1 (according to the invention) is obtained as follows:

8 g of the solution with 10% by weight polydiol copolymer A1-1 in the Group III base oil prepared previously is introduced into a flask. 223 mg of boronic diester A2-1 is added to this solution. The solution thus obtained is maintained under stirring at 90° C. until the boronic diester is completely dissolved. A solution with 10% by weight polydiol copolymer A1-1 and 80 mol. % boronic diester A2-1 with respect to the diol functions of the polydiol copolymer A1-1 is obtained.

Composition B-2 (not according to the invention) is obtained as follows:

6.52 g of polydiol copolymer A1-2 and 58.7 g of Group III base oil are introduced into a flask. The solution thus obtained is maintained under stirring at 90° C. until the polydiol is completely dissolved. A solution with 10% by weight polydiol copolymer A1 -2 is obtained.

Composition C-2 (according to the invention) is obtained as follows:

8 g of the solution with 10% by weight polydiol copolymer A1 -2 in the Group III base oil prepared previously is introduced into a flask. 65.4 mg of boronic diester A2-1 is added to this solution. The solution thus obtained is maintained under stirring at 90° C. until the boronic diester is completely dissolved. A solution with 10% by weight polydiol copolymer A1-2 and 20 mol. % boronic diester A2-1 with respect to the diol functions of the polydiol copolymer A1 -2 is obtained.

Composition D-2 (according to the invention) is obtained as follows:

8 g of the solution with 10% by weight polydiol copolymer A1 -2 in the Group III base oil prepared previously is introduced into a flask. 262 mg of boronic diester A2-1 is added to this solution. The solution thus obtained is maintained under stirring at 90° C. until the boronic diester is completely dissolved. A solution with 10% by weight polydiol copolymer A1-2 and 80 mol. % boronic diester A2-1 with respect to the diol functions of the polydiol copolymer A1 -2 is obtained.

Composition B-3 (not according to the invention) is obtained as follows:

7.24 g of polydiol copolymer A1-3 and 65.2 g of Group III base oil are introduced into a flask. The solution thus obtained is maintained under stirring at 90° C. until the polydiol is completely dissolved. A solution with 10% by weight polydiol copolymer A1 -3 is obtained.

Composition C-3 (according to the invention) is obtained as follows:

8 g of the solution with 10% by weight polydiol copolymer A1 -3 in the Group III base oil prepared previously is introduced into a flask. 28.2 mg of boronic diester A2-1 is added to this solution. The solution thus obtained is maintained under stirring at 90° C. until the boronic diester is completely dissolved. A solution with 10% by weight polydiol copolymer A1-3 and 20 mol. % boronic diester A2-1 with respect to the diol functions of the polydiol copolymer A1 -3 is obtained.

Composition B-4 (not according to the invention) is obtained as follows:

4.99 g of polydiol copolymer A1-4 and 44.4 g of Group III base oil are introduced into a flask. The solution thus obtained is maintained under stirring at 90° C. until the polydiol is completely dissolved. A solution with 10% by weight polydiol copolymer A1 -4 is obtained.

Composition C-4 (according to the invention) is obtained as follows:

6.01 g of the solution with 10% by weight polydiol copolymer A1-4 in the Group III base oil prepared previously is introduced into a flask. 18.6 mg of boronic diester A2-1 is added to this solution. The solution thus obtained is maintained under stirring at 90° C. until the boronic diester is completely dissolved. A solution with 10% by weight polydiol copolymer A1-4 and 20 mol. % boronic diester A2-1 with respect to the diol functions of the polydiol copolymer A1 -4 is obtained.

Composition D-4 (according to the invention) is obtained as follows:

6.03 g of the solution with 10% by weight polydiol copolymer A1-4 in the Group III base oil prepared previously is introduced into a flask. 74.7 mg of boronic diester A2-1 is added to this solution. The solution thus obtained is maintained under stirring at 90° C. until the boronic diester is completely dissolved. A solution with 10% by weight polydiol copolymer A1-4 and 80 mol. % boronic diester A2-1 with respect to the diol functions of the polydiol copolymer A1 -4 is obtained.

Rheology Results Obtained

Figure 5:
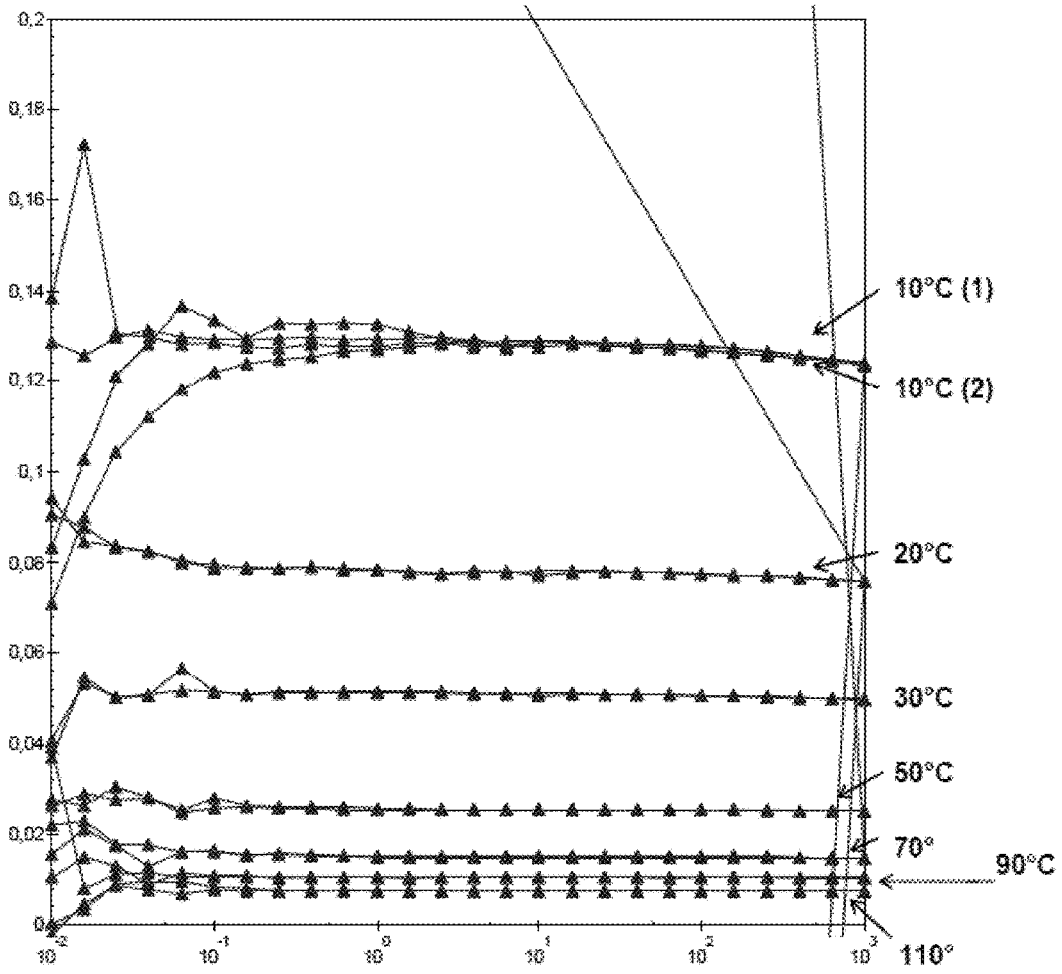
FIG. 5 shows the variation, for different temperatures comprised between 10° C. and 110° C., of the viscosity (Pa·s, y-axis) as a function of the shear rate ($s^{-1}$, x-axis) of a solution at 10% by weight of a polydiol statistical copolymer A1-1 and 0.77% by weight of a diboronic ester compound A2-1 in the group III base oil.
Figure 6A:
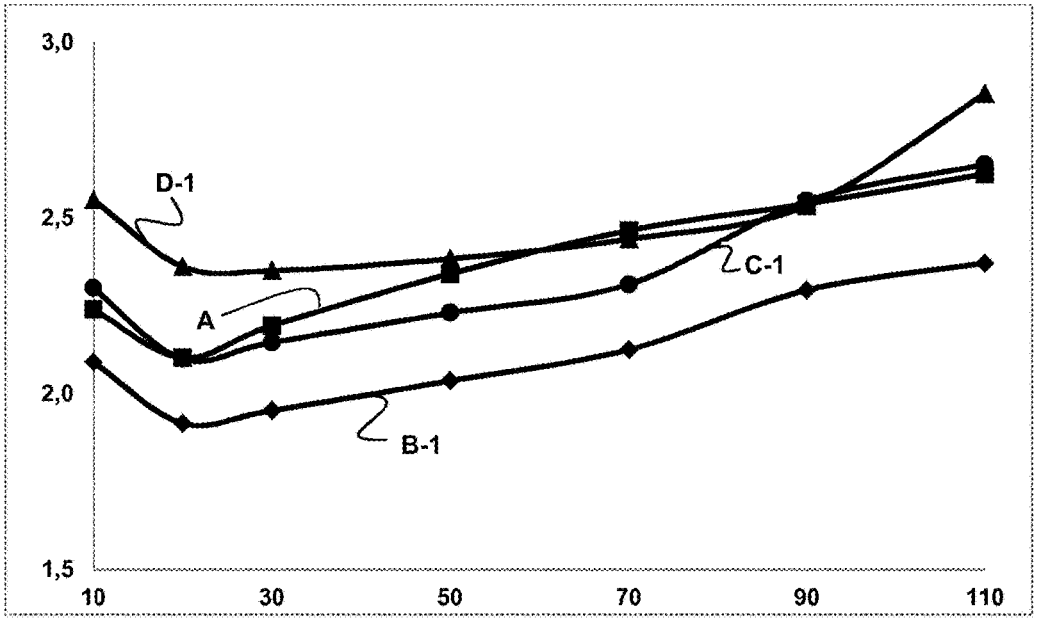
FIG. 6A shows the change in the relative viscosity (without units, y-axis) as a function of the temperature (° C., x-axis) of the compositions A, B-1, C-1 and D-1.
Figure 6B:
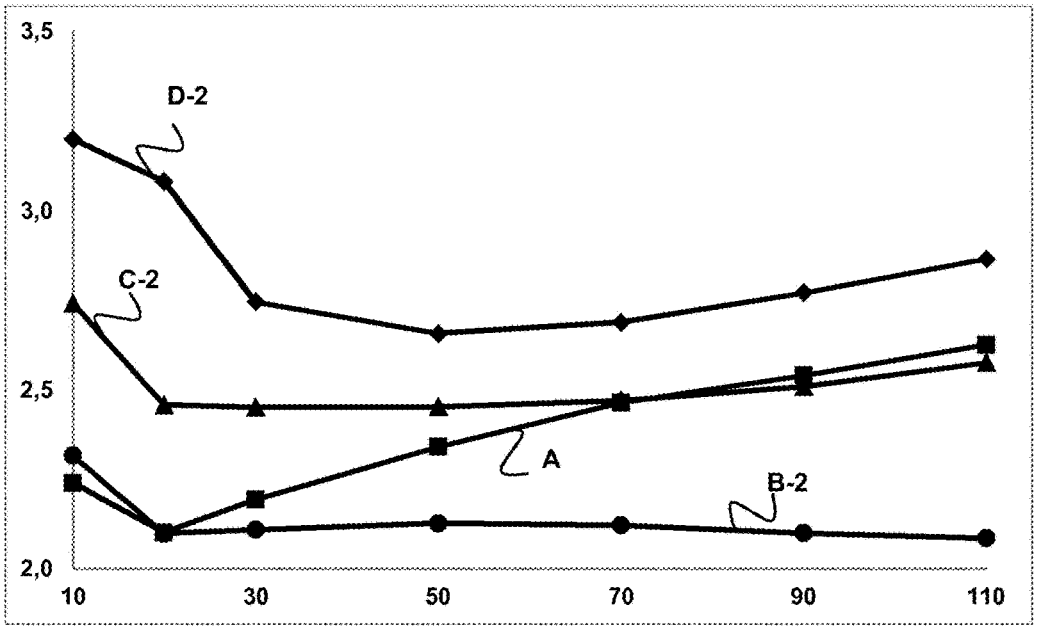
FIG. 6B shows the change in the relative viscosity (without units, y-axis) as a function of the temperature (° C., x-axis) of the compositions A, B-2, C-2 and D-2.
Figure 6C:
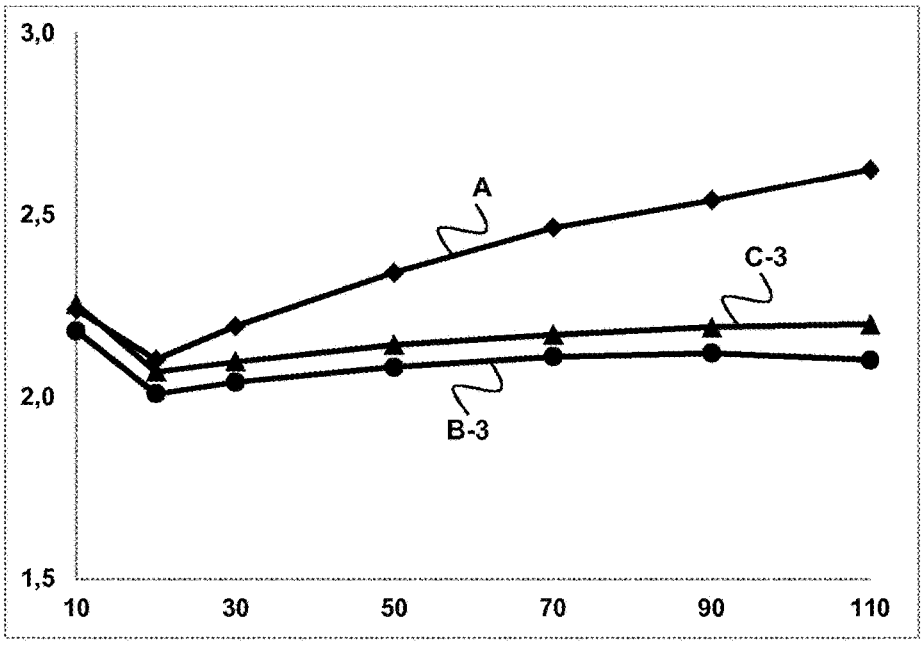
FIG. 6C shows the change in the relative viscosity (without units, y-axis) as a function of the temperature (° C., x-axis) of the compositions A, B-3 and C-3.
Figure 6D:
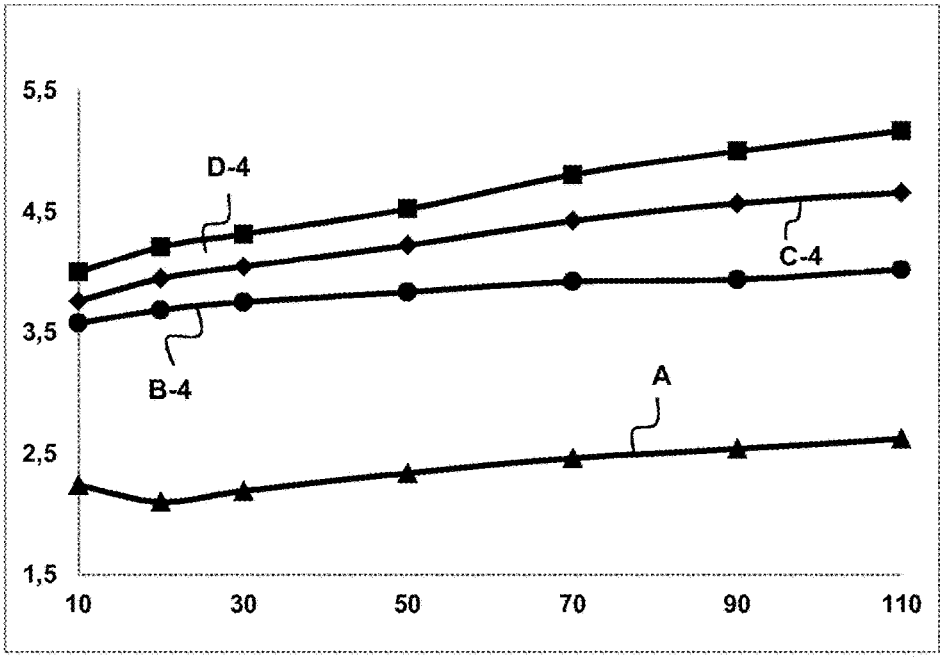
FIG. 6D shows the change in the relative viscosity (without units, y-axis) as a function of the temperature (° C., x-axis) of the compositions A, B-4, C-4 and D-4.

The rheological behaviour of composition C1-1 was studied in the case of a temperature range from 10° C. to 110° C. The results are presented in FIG. 5. The dynamic viscosity of composition C1-1 varies at low shear rates and for temperatures below 50° C. Composition C1-1 deforms under shear stress at temperatures below 50° C. For temperatures above 50° C., the dynamic viscosity of composition C1-1 varies very slightly or does not vary at low shear rates. Composition C1-1 no longer deforms under shear stress at these temperatures.

The relative viscosity of compositions A, B-1, C-1, D-1, B-2, C-2, D-2, B-3, C-3, D-3, B-4, C-4, D-4 was studied. The change in the relative viscosity of these compositions is illustrated in FIGS. 6A-6D. By comparing the results obtained, it is observed that certain parameters influence the relative viscosity of the compositions.

The Influence of LC (Average Pendant Side Chain Length)

The polydiol copolymers A1-1 and A1-2 have the same percentage of diol monomer (M1) per chain, comparable molar weights, but a different average alkyl chain length of the monomers ($L_C$=13.8 and $L_C$=10.8 respectively). The change in the relative viscosity as a function of the temperature for the solutions formulated from these polymers (FIGS. 6A and 6B) indicate that the average alkyl chain length of the monomers constituting the polydiol copolymer plays a role in the rheological properties of the formulations.

The Influence of the Molar Percentage of Diol Monomer (% Diol)

The polydiol copolymers A1-1 and A1-3 have the same average alkyl chain length ($L_C$), comparable molar weights but a different percentage of diol monomer (M1) per backbone chain (20% and 10% respectively). The change in the relative viscosity as a function of the temperature for the solutions formulated from these polymers (FIGS. 6A and 6C) indicates that the percentage of diol monomer per skeletal chain plays a role in the rheological properties of the formulations.

The Influence of the Molar Weights (DPn)

The polydiols A1-3 and A1-4 have the same percentage of diol monomer (M1) per chain, the same average alkyl chain length ($L_C$) but substantially different molar weights (47,800 g/mol and 97,100 g/mol respectively) and substantially different number-average degrees of polymerization ($DP_n$ of 198 and 228 respectively). The change in the relative viscosity as a function of the temperature for the solutions formulated from these polymers (FIGS. 6.C and 6.D) indicates that the molar weight of the polydiol copolymers (Mn) plays a role in the rheological properties of the formulations.

3.2: Compositions Based on Polydiol Statistical Copolymers A1 and Boronic Ester Polymer Compounds A2

Compositions Tested

Copolymers A1:

A poly(alkyl methacrylate-co-alkyldiol methacrylate) statistical copolymer of the invention is tested. The copolymer is as follows:

Copolymer A1-1: This copolymer comprises 20 mol. % monomers having diol functions. The average side chain length is 13.8 carbon atoms. Its number-average molar weight is 49,600 g/mol. Its polydispersity index is 1.51. Its number-average degree of polymerization ($DP_n$) is 167. The number-average molar weight and the polydispersity index are measured by steric exclusion chromatography measurement using a polystyrene calibration.

Copolymer A1-1 is obtained according to one of the protocols described in paragraph 1.

Compound A2:

Compound A2-2 is the boronic ester polymer obtained according to the protocol described in paragraph 2.2. This copolymer comprises 4 mol. % monomers having boronic ester functions. The average side chain length is greater than 12 carbon atoms. Its number-average molar weight is 37,200 g/mol. Its polydispersity index is 1.24. Its number-average degree of polymerization ($DP_n$) is 166. The number-average molar weight and the polydispersity index are measured by steric exclusion chromatography measurement using a polystyrene calibration.

Lubricating Base Oil

The lubricating base oil used in the compositions to be tested is the Group III oil described previously in paragraph 3.1.

The composition A (not according to the invention) used as reference is the same as the composition A used in paragraph 3.1.

Composition B (not according to the invention) is obtained as follows:

Composition B is the same composition B-1 used in paragraph 3.1.

Composition C (according to the invention) is obtained as follows:

4 g of the solution with 10% by weight polydiol copolymer A1-1 in the Group III base oil prepared previously is introduced into a flask. 76.8 mg of boronic ester polymer A2-2 and 4 g of the Group III base oil are added to this solution. The solution thus obtained is maintained under stirring at 90° C. until the boronic ester polymer is completely dissolved. A solution with 5% by weight polydiol copolymer A1-1 and 1% by weight boronic ester polymer A2-2 with respect to the total weight of the composition is obtained.

Composition D (according to the invention) is obtained as follows:

6 g of the preceding composition C (i.e. a composition at 5% by weight polydiol copolymer A1-1 and 1% by weight boronic ester polymer A2-2 with respect to the total weight of the composition) is introduced into a flask. 61.9 mg of boronic ester polymer A2-2 is added to this solution. The solution thus obtained is maintained under stirring at 90° C. until the boronic ester polymer is completely dissolved. A solution with 5% by weight polydiol copolymer A1-1 and 2% by weight boronic ester polymer A2-2 with respect to the total weight of the composition is obtained.

Composition E (according to the invention) is obtained as follows:

3 g of the solution with 10% by weight polydiol copolymer A1-1 in the Group III base oil prepared previously is introduced into a flask. 176 mg of boronic ester polymer A2-2 and 3 g of the Group III base oil are added to this solution. The solution thus obtained is maintained under stirring at 90° C. until the boronic ester polymer is completely dissolved. A solution with 5% by weight polydiol copolymer A1-1 and 3% by weight boronic ester polymer A2-2 with respect to the total weight of the composition is obtained.

Rheology Results Obtained

Figure 7:
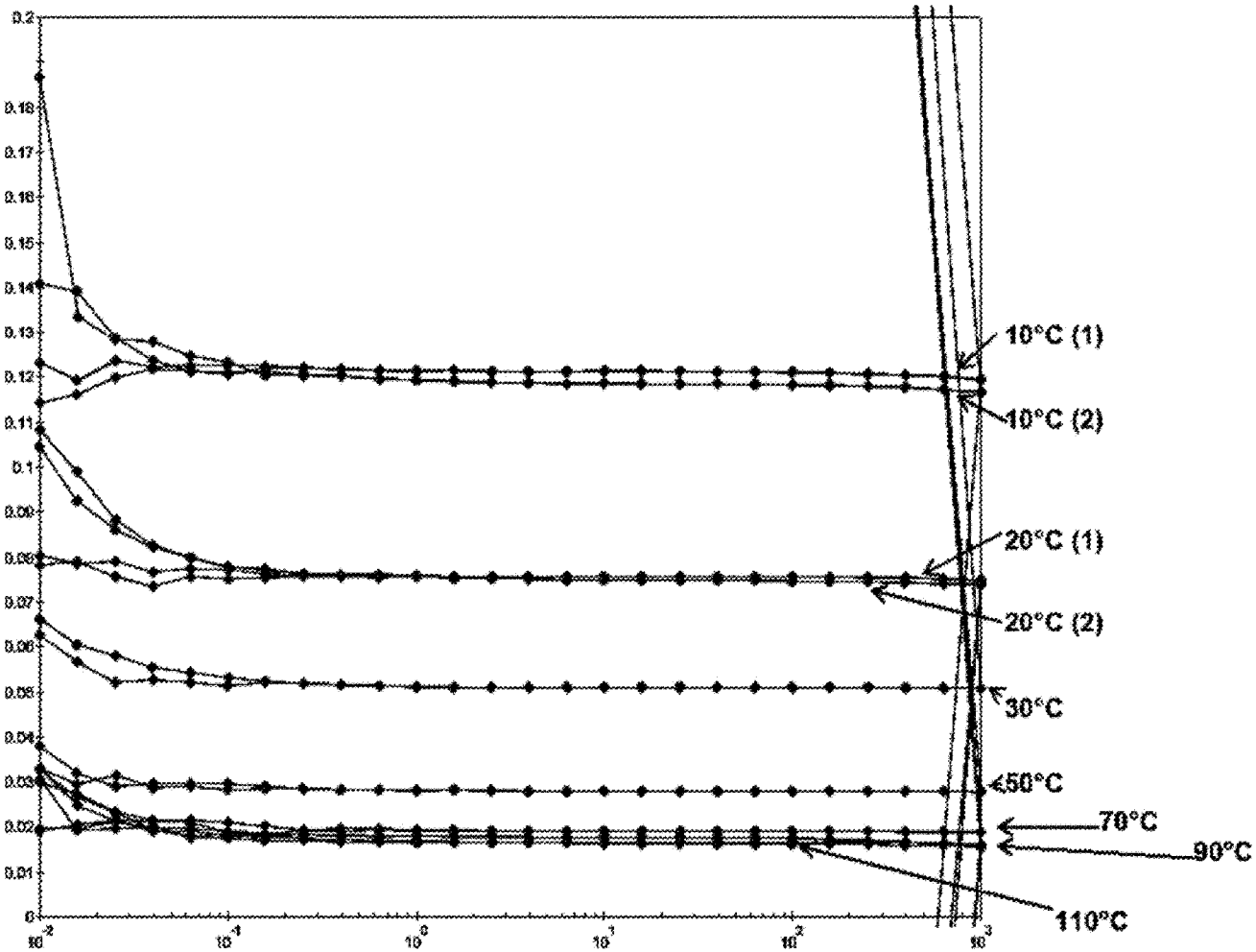
FIG. 7 shows the variation, for different temperatures comprised between 10° C. and 110° C., in the viscosity (Pa·s, y-axis) as a function of the shear rate ($s^{-1}$, x-axis) of the composition E.

The rheological behaviour of composition E was studied for a temperature range from 10° C. to 110° C. The results are presented in FIG. 7. The dynamic viscosity of composition E varies at low shear rates and for temperatures below 50° C. Composition E deforms under shear stress at temperatures below 50° C. In the case of temperatures above 50° C., the dynamic viscosity of composition E varies very slightly or does not vary at low shear rates. Composition E no longer deforms under shear stress at these temperatures.

Figure 8:
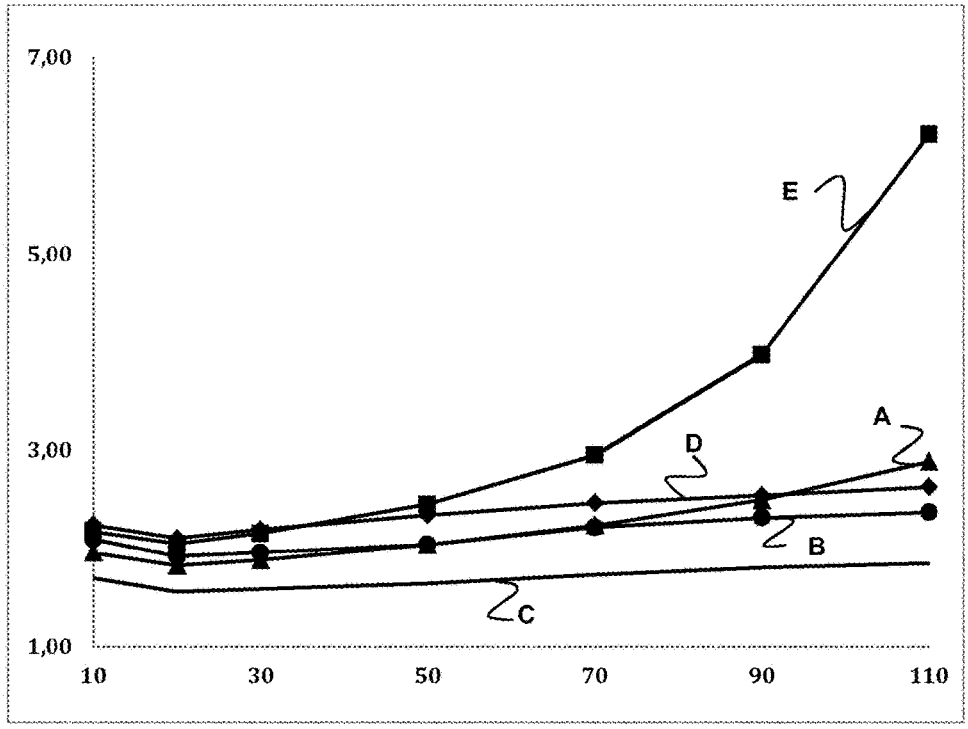
FIG. 8 shows the change in the relative viscosity (without units, y-axis) as a function of the temperature (° C., x-axis) of the compositions A, B, C, D and E.

The relative viscosity of compositions A, B, C, D and E was studied. The change in the relative viscosity of these compositions is illustrated in FIG. 8. This figure indicates that the polydiol/poly(boronic ester) systems make it possible to very significantly compensate for the drop in natural viscosity of the base oil as a function of the temperature. Furthermore, the effect obtained can be regulated by adjusting the concentrations by weight of the different polymers in solution in the base oil III.

Composition F (not according to the invention) is obtained as follows:

A VI booster polymer (Viscoplex V6.850 marketed by the company Rohmax) is added to the lubricating base oil described above. Viscoplex 6.850 comprises 41.8% linear polymethacrylate active material.

The composition thus obtained has the following characteristics; the percentages shown correspond to percentages by weight with respect to the total weight of composition F:

| | % |
|---|---|
| Lubricating base oil | 80.86 |
| Viscoplex V6.850 | 19.14 (corresponding to 8% polymethacrylate active material) |

The kinematic viscosities at 40° C. and at 100° C. are measured for compositions E and F according to the standard ASTM D445 and the VI (Viscosity Index) is calculated for these two compositions; the results are shown in Table I below.

TABLE I

| | Composition E | Composition F |
|---|---|---|
| KV 40 ($mm^2/s$) | 48.16 | 98.17 |
| KV 100 ($mm^2/s$) | 21.417 | 23.82 |
| VI | 450 | 274 |

These results shown that the lubricating compositions according to the invention exhibit a very clear increase in VI with respect to a lubricating composition comprising a conventional VI booster polymer. It is to be noted that this increase in VI is demonstrated without increasing the polymer content of the lubricating composition.

The invention claimed is:

1. A composition resulting from a mixture comprising:

(a) at least one lubricating oil;

(b) at least one statistical copolymer A1 and at least one compound A2 comprising at least two boronic ester functions;

the statistical copolymer A1 resulting from the copolymerization:

(i) of at least one first monomer M1 of general formula (I)

(I)

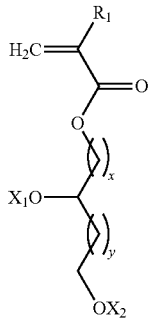

in which:

$R_1$ is selected from a group formed by —H, —$CH_3$ and —$CH_2$—$CH_3$;

x is an integer ranging from 2 to 18;

y is an integer equal to 0 or 1;

$X_1$ and $X_2$, identical or different, are selected from a group formed by hydrogen, tetrahydropyranyl, methyloxymethyl, ter-butyl, benzyl, trimethylsilyl and t-butyl dimethylsilyl; or $X_1$ and $X_2$ form with the oxygen atoms a bridge of the following formula

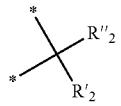

in which:

the stars (*) symbolize the bonds to the oxygen atoms;

$R'_2$ and $R''_2$, identical or different, are selected from a group formed by hydrogen and a $C_1$-$C_{11}$ alkyl; or $X_1$ and $X_2$ form with the oxygen atoms a boronic ester of the following formula

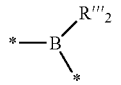

in which:

the stars (*) symbolize the bonds to the oxygen atoms;

$R'''_2$ is selected from a group formed by a $C_6$-$C_{18}$ aryl, a $C_7$-$C_{18}$ aralkyl and $C_2$-$C_{18}$ alkyl;

(ii) with at least one second monomer M2 of general formula (II-A):

(II-A)

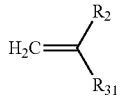

in which:

$R_2$ is selected from a group formed by —H, —$CH_3$ and —$CH_2$—$CH_3$; and $R_{31}$ is selected from a group formed by a $C_6$-$C_{18}$ aryl, a $C_6$-$C_{18}$ aryl substituted by an $R'_3$, —C(O)—O—$R'_3$; —O—$R'_3$ , —S—$R'_3$ and —C(O)—N(H)—$R'_3$ group with $R'_3$ a $C_1$-$C_{30}$ alkyl group, wherein the composition resulting from the mixture comprises the statistical copolymer A1 which can be cross-linked to the at least one compound A2 in a thermoreversible manner.

2. The composition according to claim 1, in which statistical copolymer A1 results from the copolymerization of at least one monomer M1 with at least two monomers M2 having different $R_{31}$ groups.

3. The composition according to claim 2, in which one of the monomers M2 of the statistical copolymer A1 has the general formula (II-A1):

(II-A1)

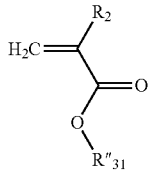

in which:

$R_2$ is selected from a group formed by —H, —$CH_3$ and —$CH_2$—$CH_3$;

$R''_{31}$ is a $C_1$-$C_{14}$ alkyl group;

and the other monomer M2 of the statistical copolymer A1 has the general formula (II-A2):

(II-A2)

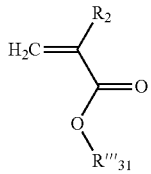

in which:

$R_2$ is selected from a group formed by —H, —$CH_3$ and —$CH_2$—$CH_3$; and $R'''_{31}$ is a $C_{15}$-$C_{30}$ alkyl group.

4. The composition according to claim 1, in which the compound A2 is a compound of formula (III):

(III)

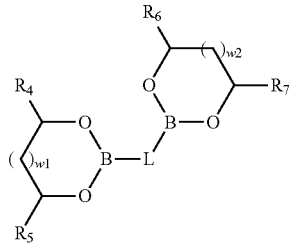

in which:

$w_1$ and $w_2$, identical or different are integers selected between 0 and 1;

$R_4$, $R_5$, $R_6$ and $R_7$, identical or different are selected from a group formed by hydrogen and a hydrocarbon-containing group having from 1 to 24 carbon atoms; and L is a divalent bond group and is selected from a group formed by a $C_6$-$C_{18}$ aryl, a $C_6$-$C_{18}$ aralkyl and a $C_2$-$C_{24}$ hydrocarbon-containing chain.

5. The composition according to claim 1, in which the compound A2 is a statistical copolymer resulting from the copolymerization of at least one monomer M3 of formula (IV):

(IV)

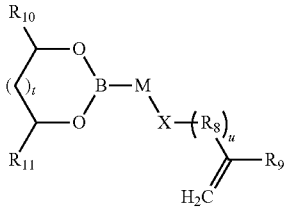

in which:

t is an integer equal to 0 or 1;

u is an integer equal to 0 or 1;

M and $R_8$ are divalent bond groups, identical or different, are selected from a group formed by a $C_6$-$C_{18}$ aryl, a $C_7$-$C_{24}$ aralkyl and $C_2$-$C_{24}$ alkyl;

X is a function selected from a group formed by —O—C(O)—, —C(O)—O—, —C(O)—N(H)—, —N(H)—C(O)—, —S—, —N(H)—, —N(R'$_4$)- and —O—with R'$_4$ a hydrocarbon-containing chain comprising from 1 to 15 carbon atoms;

$R_9$ is selected from a group formed by —H, —$CH_3$ and —$CH_2$—$CH_3$;

$R_{10}$ and $R_{11}$ identical or different selected from a group formed by hydrogen and a hydrocarbon-containing group having from 1 to 24 carbon atoms;

with at least one second monomer M4 of general formula (V):

(V)

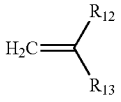

in which:

$R_{12}$ is selected from a group formed by —H, —$CH_3$ and —$CH_2$—$CH_3$; and $R_{13}$ is selected from a group formed by a $C_6$-$C_{18}$ aryl, a $C_6$-$C_{18}$ aryl substituted by an R'$_{13}$, —C(O)—O—R'$_{13}$; —O—R'$_{13}$ , —S—R'$_{13}$ and —C(—)—N(H)—R'$_{13}$ group with R'$_{13}$ a $C_1$-$C_{25}$ alkyl group.

6. The composition according to claim 5, in which the chain formed by the sequence of $R_{10}$, M, X and $(R_8)_u$ groups with u equal to 0 or 1 of the monomer of general formula (IV) has a total number of carbon atoms comprised between 8 and 38.

7. The composition according to claim 5, in which the side chains of the copolymer A2 have an average length greater than 8 carbon atoms.

8. The composition according to claim 5, in which the statistical copolymer A2 has a molar percentage of monomer of formula (IV) in the copolymer ranging from 0.25 to 20%.

9. The composition according to claim 5, in which the statistical copolymer A2 has a number-average degree of polymerization ranging from 50 to 1500.

10. The composition according to claim 1, in which the side chains of the statistical copolymer A1 have an average length ranging from 8 to 20 carbon atoms.

11. The composition according to claim 1, in which the statistical copolymer A1 has a molar percentage of monomer M1 of formula (I) ranging in said copolymer from 1 to 30%.

12. The composition according to claim 1, in which the statistical copolymer A1 has an average degree of polymerization ranging from 100 to 2000.

13. The composition according to claim 1, in which the lubricating oil is selected from the oils of Group I, Group II, Group III, Group IV, Group V of the API classification and a mixture thereof.

14. The composition according to claim 1, further comprising a functional additive selected from a group formed by detergents, anti-wear additives, extreme-pressure additives, additional antioxidants, polymers improving the viscosity index, pour point improvers, anti-foaming agents, corrosion inhibitors, thickeners, dispersants, friction modifiers and mixtures thereof.

15. The composition according to claim 1, in which a mass ratio between the statistical copolymer A1 and the compound A2 (ratio A1/A2) ranges from 0.001 to 100.

16. The composition according to claim 1, in which a sum of masses of the statistical copolymer A1 and of the compound A2 ranges from 0.5 to 20% with respect to a total mass of the lubricating composition and a mass of lubricating oil ranges from 80% to 99.5% with respect to the total mass of the lubricating composition.

17. A stock composition resulting from mixing:

(a) at least one statistical copolymer A1;

(b) at least one compound A2 comprising at least two boronic ester functions; and (c) at least one functional additive selected from a group formed by the detergents, anti-wear additives, extreme-pressure additives, antioxidants, polymers improving the viscosity index, pour point improvers, anti-foaming agents, thickeners, dispersants, friction modifiers and mixtures thereof;

the statistical copolymer A1 resulting from the copolymerization (i) of at least one first monomer M1 of general formula (I)

(I)

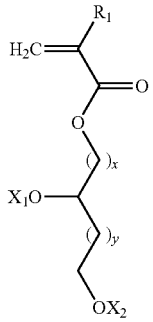

in which:

$R_1$ is selected from a group formed by —H, —$CH_3$ and —$CH_2$—$CH_3$;

x is an integer ranging from 2 to 18;

y is an integer equal to 0 or 1;

$X_1$ and $X_2$, identical or different, are selected from a group formed by hydrogen, tetrahydropyranyl, methyloxymethyl, ter-butyl, benzyl, trimethylsilyl and t-butyl dimethylsilyl;

or $X_1$ and $X_2$ form with the oxygen atoms a bridge of the following formula

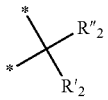

in which:

the stars (*) symbolize the bonds to the oxygen atoms;

$R'_2$ and $R''_2$, identical or different, are selected from a group formed by hydrogen and a $C_1$-$C_{11}$ alkyl;

or $X_1$ and $X_2$ form with the oxygen atoms a boronic ester of the following formula

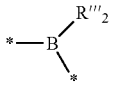

in which:

the stars (*) symbolize the bonds to the oxygen atoms;

$R'''_2$ is selected from a group formed by a $C_6$-$C_{18}$ aryl, a $C_7$-$C_{18}$ aralkyl and $C_2$-$C_{18}$ alkyl;

(ii) with at least one second monomer M2 of general formula (II-A):

(II-A)

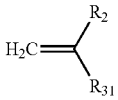

in which:

$R_2$ is selected from a group formed by —H, —$CH_3$ and —$CH_2$—$CH_3$; and $R_{31}$ is selected from a group formed by a $C_6$-$C_{18}$ aryl, a $C_6$-$C_{18}$ aryl substituted by an $R'_3$, —C(O)—O—$R'_3$; —O—$R'_3$ , —S—$R'_3$ and —C(O)—N(H)—$R'_3$ group with $R'_3$ a $C_1$-$C_{30}$ alkyl group, wherein the stock composition resulting from the mixture comprises the statistical copolymer A1 which can be cross-linked to the at least one compound A2 in a thermoreversible manner.

18. The composition according to claim 1, wherein the viscosity increases when the temperature increases.

19. The composition according to claim 4, in which the compound A2 is compound A2-1 having the structure:

(A2-1)

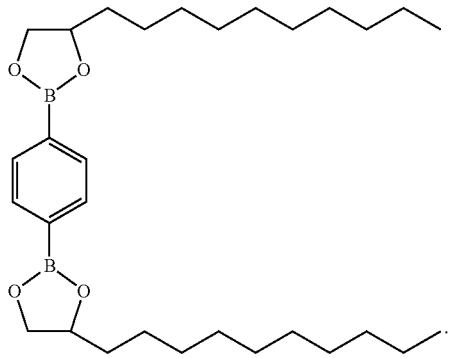

20. The composition according to claim 5, in which monomer M3 of formula (IV) is compound A2-2 having the structure:

(A2-2)

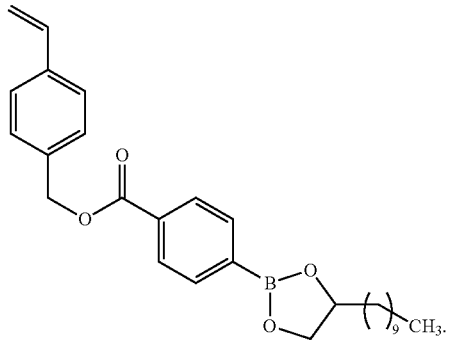

* * * * *